US011063344B2

(12) United States Patent
Tehran et al.

(10) Patent No.: US 11,063,344 B2
(45) Date of Patent: Jul. 13, 2021

(54) HIGH GAIN AND LARGE BANDWIDTH ANTENNA INCORPORATING A BUILT-IN DIFFERENTIAL FEEDING SCHEME

(71) Applicant: Samsung Electronics Co., Ltd., Suwon-si (KR)

(72) Inventors: Hamid Reza Memar Zadeh Tehran, Richardson, TX (US); Gary Xu, Allen, TX (US); Won Suk Choi, Plano, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 57 days.

(21) Appl. No.: 16/275,215

(22) Filed: Feb. 13, 2019

(65) Prior Publication Data

US 2019/0260115 A1 Aug. 22, 2019

Related U.S. Application Data

(60) Provisional application No. 62/642,924, filed on Mar. 14, 2018, provisional application No. 62/632,872, filed on Feb. 20, 2018.

(51) Int. Cl.
*H01Q 1/24* (2006.01)
*H01Q 21/00* (2006.01)
(Continued)

(52) U.S. Cl.
CPC ..... *H01Q 1/246* (2013.01); *H01Q 9/045* (2013.01); *H01Q 21/0025* (2013.01); *H01Q 21/064* (2013.01)

(58) Field of Classification Search
CPC ..... H01Q 21/30; H01Q 5/50; H01Q 9/045; H01Q 19/00; H01Q 1/1207; H01Q 1/2283;
(Continued)

(56) References Cited

U.S. PATENT DOCUMENTS 9,123,992 B2 9/2015 Lee
9,391,370 B2 7/2016 Tzanidis et al.
(Continued)

FOREIGN PATENT DOCUMENTS

KR 10-2006-0095372 A 8/2006
KR 10-2010-0034227 A 4/2010
(Continued)

OTHER PUBLICATIONS

International Search Report dated May 28, 2019 in connection with International Patent Application No. PCT/KR2019/002056, 5 pages.
(Continued)

*Primary Examiner* — Monica C King

(57) ABSTRACT

The present disclosure includes an antenna and a base station including an antenna. The antenna includes at least one unit cell that includes a flap layer, a feed network, and a patch. The flap layer includes a plurality of flaps. The feed network is positioned below the flap layer and includes a plurality of feed lines. Each of the plurality of feed lines includes an excitation port and a transmission line. The patch has a quadrilateral shape and is positioned above the flap layer such that an air gap is present between the patch and the flap layer.

20 Claims, 16 Drawing Sheets

(51) Int. Cl.
*H01Q 9/04* (2006.01)
*H01Q 21/06* (2006.01)

(58) Field of Classification Search
CPC ..... H01Q 1/28; H01Q 1/286; H01Q 1/3225; H01Q 1/3233; H01Q 1/3291; H01Q 1/40; H01Q 1/44; H01Q 1/521; H01Q 1/528; H01Q 21/0006; H01Q 21/0018; H01Q 21/005; H01Q 21/06; H01Q 21/061; H01Q 21/062; H01Q 21/20; H01Q 21/205; H01Q 21/26; H01Q 23/00; H01Q 3/24; H01Q 3/2617; H01Q 5/314; H01Q 5/35; H01Q 5/378; H01Q 9/0414; H01Q 9/0428; H01Q 9/0464; H01Q 9/0485; H01Q 9/16; H01Q 9/285; H01Q 9/36; H01Q 9/42; H04L 5/14; H04L 2025/03414; H04L 27/01; H04L 27/2636; H04L 27/265; H04L 5/0007; H04L 5/0023; H04L 5/0028; H04L 1/0001; H04L 1/0003; H04L 1/0009; H04L 1/004; H04L 1/1607; H04L 1/1664; H04L 1/18; H04L 25/03019; H04L 25/03828; H04L 27/0008; H04L 27/2601; H04L 27/2678; H04L 5/0048; H04L 5/006; H04L 5/0064; H04L 5/0073; H04L 5/0085; H04L 5/143; H04L 5/1438
See application file for complete search history.

(56) References Cited

U.S. PATENT DOCUMENTS

| | | | | |
|---|---|---|---|---|
| 9,525,211 | B2 | 12/2016 | Lee et al. | |
| 9,680,211 | B2 | 6/2017 | Kletsov et al. | |
| 2010/0073238 | A1 | 3/2010 | Jun et al. | |
| 2010/0289701 | A1 | 11/2010 | DeJean et al. | |
| 2013/0044035 | A1 | 2/2013 | Zhuang | |
| 2013/0063310 | A1 | 3/2013 | Angus et al. | |
| 2015/0042513 | A1 | 2/2015 | Foo | |
| 2015/0084814 | A1* | 3/2015 | Rojanski | H01Q 1/42 342/368 |
| 2015/0280329 | A1* | 10/2015 | Sanford | H01Q 13/02 343/786 |
| 2017/0201025 | A1 | 7/2017 | Lea et al. | |
| 2018/0205154 | A1 | 7/2018 | Baik et al. | |

FOREIGN PATENT DOCUMENTS

| | | | |
|---|---|---|---|
| KR | 10-2014-0055290 | A | 5/2014 |
| KR | 10-2017-0016377 | A | 2/2017 |
| WO | 03/028156 | A2 | 4/2003 |
| WO | 2015/065509 | A1 | 5/2015 |

OTHER PUBLICATIONS

Written Opinion of the International Searching Authority dated May 28, 2019 in connection with International Patent Application No. PCT/KR2019/002056, 5 pages.

Supplementary European Search Report in connection with European Application No. 19757167.2 dated Dec. 10, 2020, 12 pages.

Herscovici et al., "A Microstrip Array Fed by a Non-Homogeneous Stripline Feeding Network," MSMW 2001 Symposium Proceedings, Kharkov, Ukraine, Jun. 4-9, 2001, 3 pages.

* cited by examiner

HIGH GAIN AND LARGE BANDWIDTH ANTENNA INCORPORATING A BUILT-IN DIFFERENTIAL FEEDING SCHEME

CROSS-REFERENCE TO RELATED APPLICATION AND CLAIM OF PRIORITY

This application claims priority under 35 U.S.C. § 119(e) to U.S. Provisional Patent Application No. 62/632,872 filed Feb. 20, 2018 and U.S. Provisional Patent Application No. 62/642,924 filed Mar. 14, 2018, each of which are incorporated herein by reference in their entireties.

TECHNICAL FIELD

The present disclosure relates generally to an antenna structure. More specifically, the present disclosure relates to an antenna structure that generates a moderate radiated gain over a large frequency range.

BACKGROUND

The concept of Massive multi-input multi-output (MIMO) is aimed at improving the coverage and spectral efficiency of the next generation of telecommunication systems. In the next generation of telecommunication systems, users are dedicated with one or multiple spatial directions for the intended communication purposes. Massive MIMO-based systems generate multiple beams and form beams subjectively for a user or a group of users in order to increase the desired radiation efficiency. Some massive MIMO antenna systems have a large number of antenna elements. Therefore, the overall system's performance relies on the performance of individual elements which have a high gain and a reasonably small structure compared to the wavelength at the operating frequency. The operating frequency can range from 2.3-2.6 GHz and/or 3.4-3.6 GHz.

Because of the design frequency and resulting wavelength, difficulties arise in designing an antenna element with a gain of equal or better than −6 dB and a wideband radiation over a range of 3.2-3.9 GHz while maintaining a simple and cost-effective overall antenna structure that can be mass-produced.

SUMMARY

Embodiments of the present disclosure include an antenna and a base station including an antenna.

In one embodiment, an antenna includes at least one unit cell. The at least one unit cell includes a flap layer, a feed network, and a patch. The flap layer includes a plurality of flaps. The feed network is positioned below the flap layer and includes a plurality of feed lines. Each of the plurality of feed lines includes an excitation port and a transmission line. The patch has a quadrilateral shape and is positioned above the flap layer such that an air gap is present between the patch and the flap layer.

In another embodiment, a base station includes an antenna, a transceiver, and a controller. The antenna includes at least one unit cell that includes a flap layer, a feed network, and a patch. The flap layer includes a plurality of flaps. The feed network is positioned below the flap layer and includes a plurality of feed lines. Each of the plurality of feed lines includes an excitation port and a transmission line. The patch has a quadrilateral shape and is positioned above the flap layer such that an air gap is present between the patch and the flap layer. The transceiver transmits and receives signals via the antenna. The controller controls the transceiver to transmit and receive the signals.

In this disclosure, the terms antenna module, antenna array, beam, and beam steering are frequently used. An antenna module may include one or more arrays. One antenna array may include one or more antenna elements. Each antenna element may be able to provide one or more polarizations, for example vertical polarization, horizontal polarization or both vertical and horizontal polarizations simultaneously. Simultaneous vertical and horizontal polarizations can be refracted to an orthogonally polarized antenna. An antenna module radiates the accepted energy in a particular direction with a gain concentration. The radiation of energy in the particular direction is conceptually known as a beam. A beam may be a radiation pattern from one or more antenna elements or one or more antenna arrays.

Other technical features may be readily apparent to one skilled in the art from the following figures, descriptions, and claims.

Before undertaking the DETAILED DESCRIPTION below, it may be advantageous to set forth definitions of certain words and phrases used throughout the present disclosure. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout the present disclosure. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which like reference numerals represent like parts.

DETAILED DESCRIPTION

FIGS. 1 through 9C, discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged wireless communication system.

To meet the demand for wireless data traffic having increased since deployment of 4G communication systems, efforts have been made to develop an improved 5G or pre-5G communication system. Therefore, the 5G or pre-5G communication system is also called a "beyond 4G network" or a "post LTE system."

The 5G communication system is considered to be implemented in higher frequency (mmWave) bands and sub-6 GHz bands, e.g., 3.5 GHz bands, so as to accomplish higher data rates. To decrease propagation loss of the radio waves and increase the transmission coverage, the beamforming, massive multiple-input multiple-output (MIMO), full dimensional MIMO (FD-MIMO), array antenna, an analog beam forming, large scale antenna techniques and the like are discussed in 5G communication systems.

In addition, in 5G communication systems, development for system network improvement is under way based on advanced small cells, cloud radio access networks (RANs), ultra-dense networks, device-to-device (D2D) communication, wireless backhaul communication, moving network, cooperative communication, coordinated multi-points (CoMP) transmission and reception, interference mitigation and cancellation and the like.

Figure 1:
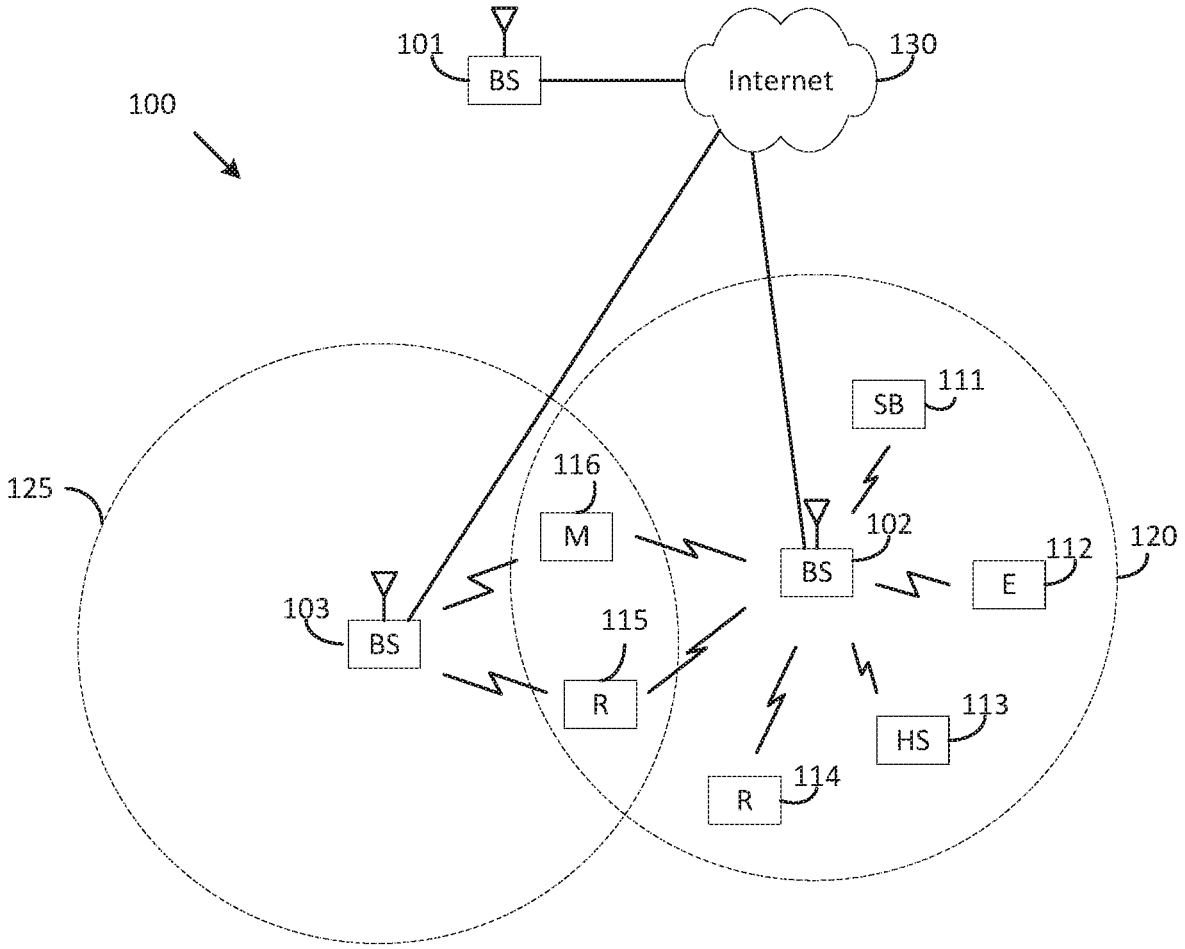
FIG. 1 illustrates a system of a network according to various embodiments of the present disclosure.

FIG. 1 illustrates an example wireless network according to embodiments of the present disclosure. The embodiment of the wireless network shown in FIG. 1 is for illustration only. Other embodiments of the wireless network 100 could be used without departing from the scope of this disclosure.

As shown in FIG. 1, the wireless network 100 includes a gNB 101, a gNB 102, and a gNB 103. The gNB 101 communicates with the gNB 102 and the gNB 103. The gNB 101 also communicates with at least one network 130, such as the Internet, a proprietary Internet Protocol (IP) network, or other data network.

The gNB 102 provides wireless broadband access to the network 130 for a first plurality of UEs within a coverage area 120 of the gNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M), such as a cell phone, a wireless laptop, a wireless PDA, or the like. The gNB 103 provides wireless broadband access to the network 130 for a second plurality of UEs within a coverage area 125 of the gNB 103. The second plurality of UEs includes the UE 115 and the UE 116. In some embodiments, one or more of the gNBs 101-103 may communicate with each other and with the UEs 111-116 using 5G, LTE, LTE-A, WiMAX, WiFi, or other wireless communication techniques.

Depending on the network type, the term "base station" or "BS" can refer to any component (or collection of components) configured to provide wireless access to a network, such as transmit point (TP), transmit-receive point (TRP), an enhanced base station (eNodeB or gNB), a 5G base station (gNB), a macrocell, a femtocell, a WiFi access point (AP), or other wirelessly enabled devices. Base stations may provide wireless access in accordance with one or more wireless communication protocols, e.g., 5G 3GPP new radio interface/access (NR), long term evolution (LTE), LTE advanced (LTE-A), high speed packet access (HSPA), Wi-Fi 802.11a/b/g/n/ac, etc. For the sake of convenience, the terms "BS" and "TRP" are used interchangeably in the present disclosure to refer to network infrastructure components that provide wireless access to remote terminals. Also, depending on the network type, the term "user equipment" or "UE" can refer to any component such as "mobile station," "subscriber station," "remote terminal," "wireless terminal," "receive point," or "user device." For the sake of convenience, the terms "user equipment" and "UE" are used in the present disclosure to refer to remote wireless equipment that wirelessly accesses a BS, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with gNBs, such as the coverage areas 120 and 125, may have other shapes, including irregular shapes, depending upon the configuration of the gNBs and variations in the radio environment associated with natural and man-made obstructions.

Although FIG. 1 illustrates one example of a wireless network, various changes may be made to FIG. 1. For example, the wireless network could include any number of gNBs and any number of UEs in any suitable arrangement. Also, the gNB 101 could communicate directly with any number of UEs and provide those UEs with wireless broadband access to the network 130. Similarly, each gNB 102-103 could communicate directly with the network 130 and provide UEs with direct wireless broadband access to the network 130. Further, the gNBs 101, 102, and/or 103 could provide access to other or additional external networks, such as external telephone networks or other types of data networks.

Figure 2:
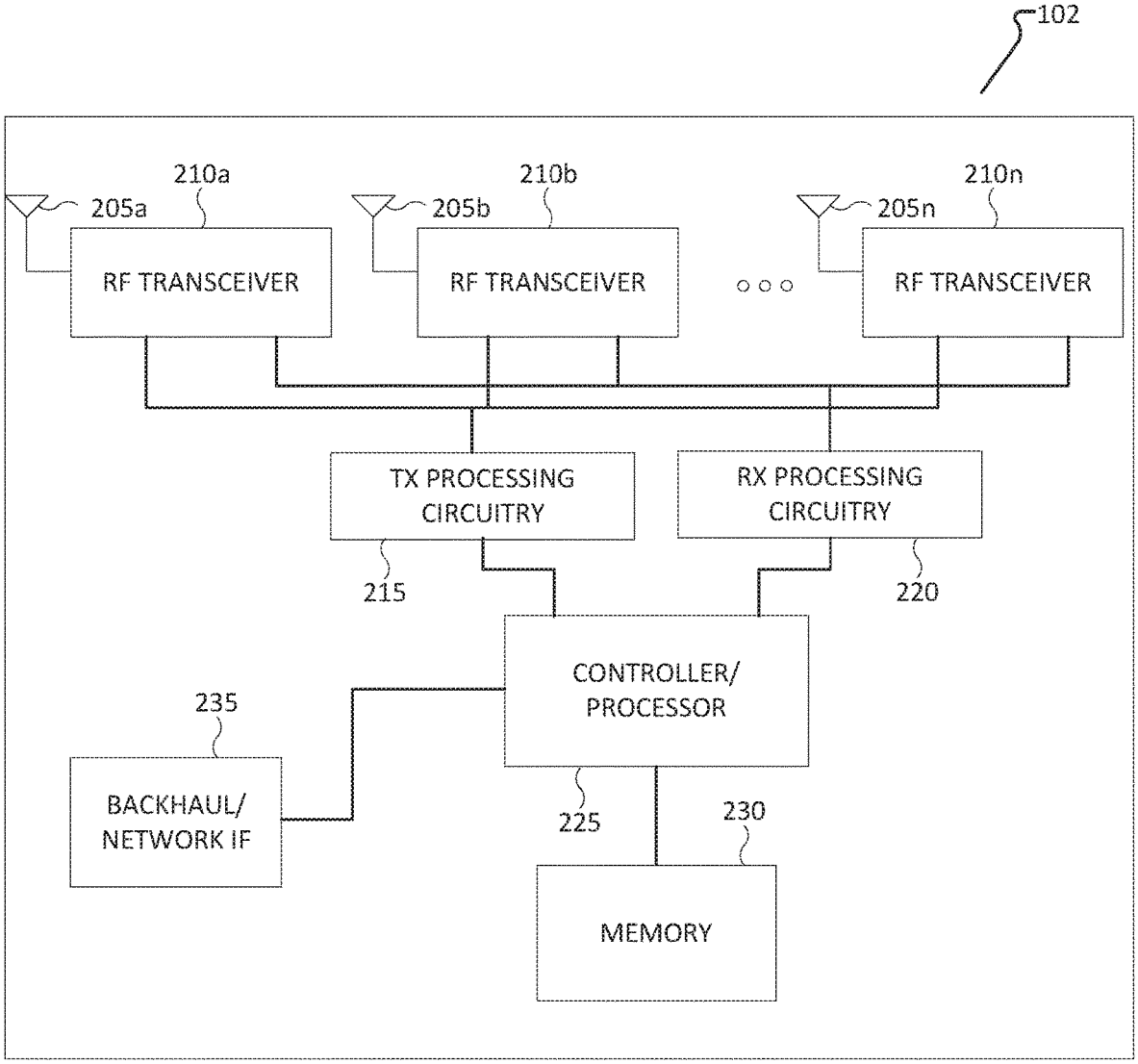
FIG. 2 illustrates a base station according to various embodiments of the present disclosure.

FIG. 2 illustrates an example gNB 102 according to embodiments of the present disclosure. The embodiment of the gNB 102 illustrated in FIG. 2 is for illustration only, and the gNBs 101 and 103 of FIG. 1 could have the same or similar configuration. However, gNBs come in a wide variety of configurations, and FIG. 2 does not limit the scope of this disclosure to any particular implementation of a gNB.

As shown in FIG. 2, the gNB 102 includes multiple antennas 205*a*-205*n*, multiple radiofrequency (RF) transceivers 210*a*-210*n*, transmit (TX) processing circuitry 215, and receive (RX) processing circuitry 220. The gNB 102 also includes a controller/processor 225, a memory 230, and a backhaul or network interface 235. In various embodiments, the antennas 205*a*-205*n* may be a high gain and large bandwidth antenna that may be designed based on a concept of multiple resonance modes and may incorporate a stacked or multiple patch antenna scheme. For example, in various embodiments, each of the multiple antennas 205*a*-205*n* can include one or more antenna panels that includes one or more unit cells (e.g., the unit cell 300 illustrated in FIGS. 3A-C or the unit cell 800 illustrated in FIGS. 8A-8C).

The RF transceivers 210*a*-210*n* receive, from the antennas 205*a*-205*n*, incoming RF signals, such as signals transmitted by UEs in the network 100. The RF transceivers 210*a*-210*n* down-convert the incoming RF signals to generate IF or baseband signals. The IF or baseband signals are sent to the RX processing circuitry 220, which generates processed baseband signals by filtering, decoding, and/or digitizing the baseband or IF signals. The RX processing circuitry 220 transmits the processed baseband signals to the controller/processor 225 for further processing.

The TX processing circuitry 215 receives analog or digital data (such as voice data, web data, e-mail, or interactive video game data) from the controller/processor 225. The TX processing circuitry 215 encodes, multiplexes, and/or digitizes the outgoing baseband data to generate processed baseband or IF signals. The RF transceivers 210*a*-210*n* receive the outgoing processed baseband or IF signals from the TX processing circuitry 215 and up-converts the baseband or IF signals to RF signals that are transmitted via the antennas 205*a*-205*n*.

The controller/processor 225 can include one or more processors or other processing devices that control the overall operation of the gNB 102. For example, the controller/processor 225 could control the reception of forward channel signals and the transmission of reverse channel signals by the RF transceivers 210*a*-210*n*, the RX processing circuitry 220, and the TX processing circuitry 215 in accordance with well-known principles. The controller/processor 225 could support additional functions as well, such as more advanced wireless communication functions. For instance, the controller/processor 225 could support beam forming or directional routing operations in which outgoing/incoming signals from/to multiple antennas 205*a*-205*n* are weighted differently to effectively steer the outgoing signals in a desired direction. Any of a wide variety of other functions could be supported in the gNB 102 by the controller/processor 225.

The controller/processor 225 is also capable of executing programs and other processes resident in the memory 230, such as an OS. The controller/processor 225 can move data into or out of the memory 230 as required by an executing process.

The controller/processor 225 is also coupled to the backhaul or network interface 235. The backhaul or network interface 235 allows the gNB 102 to communicate with other devices or systems over a backhaul connection or over a network. The interface 235 could support communications over any suitable wired or wireless connection(s). For example, when the gNB 102 is implemented as part of a cellular communication system (such as one supporting 5G, LTE, or LTE-A), the interface 235 could allow the gNB 102 to communicate with other gNBs over a wired or wireless backhaul connection. When the gNB 102 is implemented as an access point, the interface 235 could allow the gNB 102 to communicate over a wired or wireless local area network or over a wired or wireless connection to a larger network (such as the Internet). The interface 235 includes any suitable structure supporting communications over a wired or wireless connection, such as an Ethernet or RF transceiver.

The memory 230 is coupled to the controller/processor 225. Part of the memory 230 could include a RAM, and another part of the memory 230 could include a Flash memory or other ROM.

Although FIG. 2 illustrates one example of gNB 102, various changes may be made to FIG. 2. For example, the gNB 102 could include any number of each component shown in FIG. 2. As a particular example, an access point could include a number of interfaces 235, and the controller/processor 225 could support routing functions to route data between different network addresses. As another particular example, while shown as including a single instance of TX processing circuitry 215 and a single instance of RX processing circuitry 220, the gNB 102 could include multiple instances of each (such as one per RF transceiver). Also, various components in FIG. 2 could be combined, further subdivided, or omitted and additional components could be added according to particular needs.

Figure 3A:
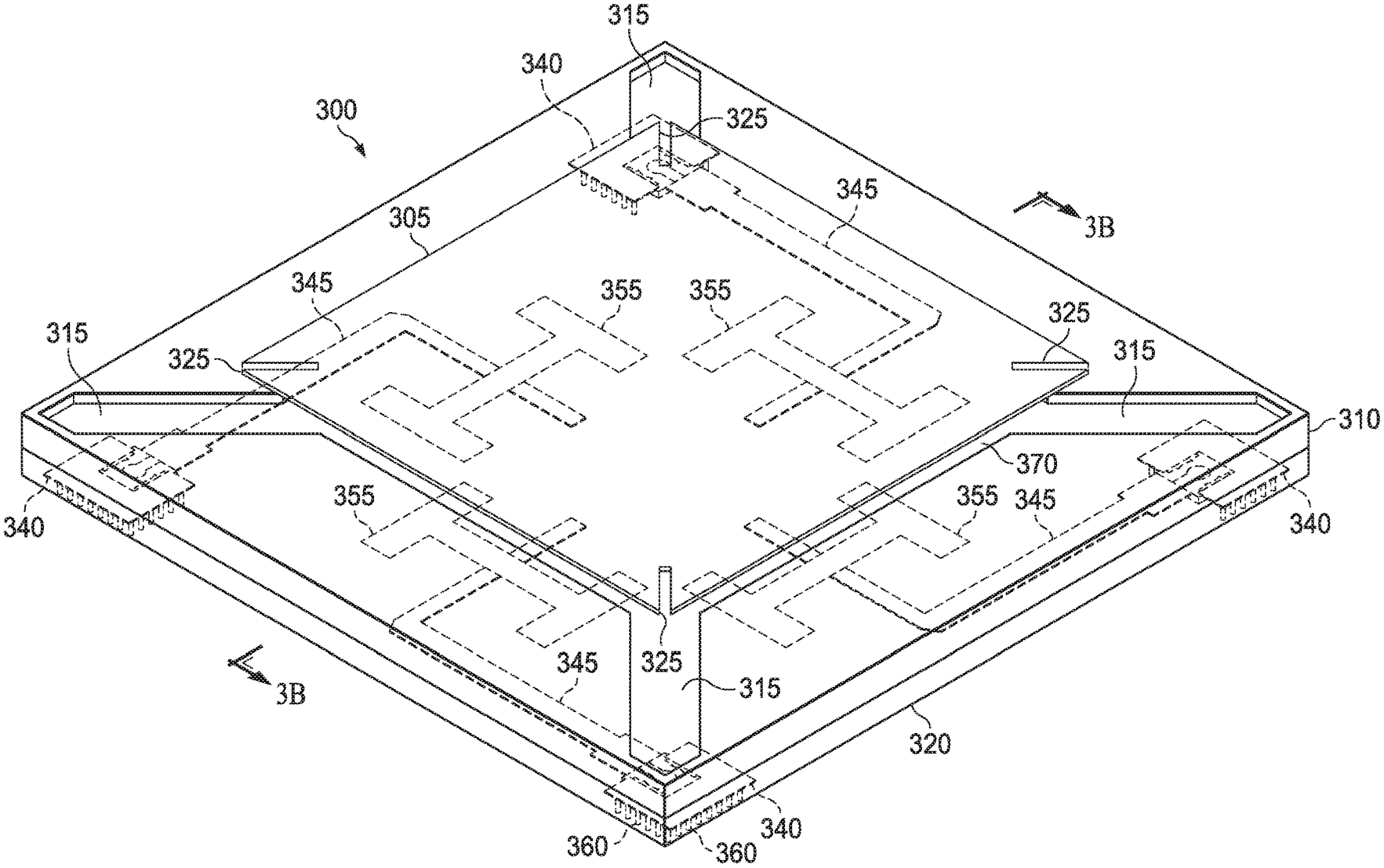
FIG. 3A illustrates a top perspective view of a unit cell according to various embodiments of the present disclosure.
Figure 3B:
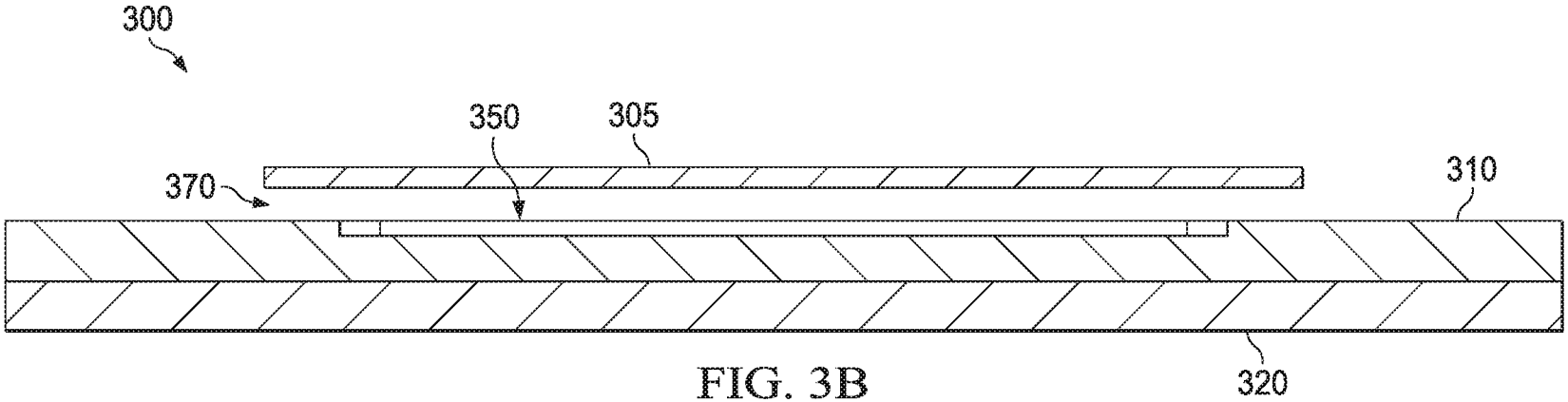
FIG. 3B illustrates a cut-through view of a unit cell according to various embodiments of the present disclosure.
Figure 3C:
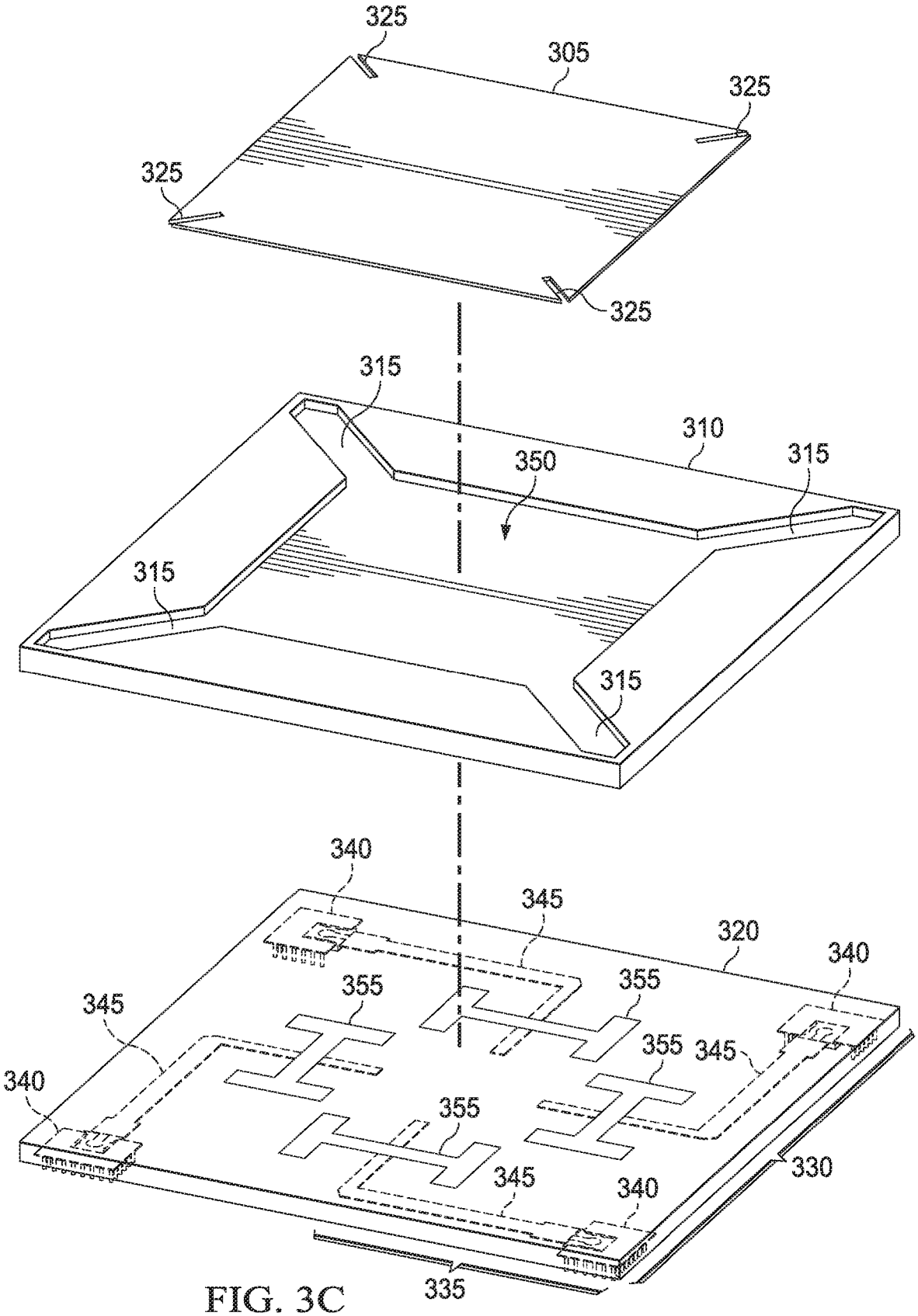
FIG. 3C illustrates an exploded view of a unit cell according to various embodiments of the present disclosure.

FIGS. 3A-3C illustrate a unit cell 300 according to various embodiments of the present disclosure. FIG. 3A illustrates a top perspective view of a unit cell 300. FIG. 3B illustrates a cut through view of the unit cell 300. FIG. 3C illustrates an exploded view of the unit cell 300. Although FIGS. 3A-3C illustrate one example of the unit cell 300, various changes can be made to the unit cell 300. For example, various components in FIGS. 3A-3C could be combined, further subdivided, or omitted and additional components could be added.

The unit cell 300 can include a first layer including a patch 305, a flap layer 310 including a plurality of flaps 315, a layer including a plurality of slots 355, and a substrate layer 320 that includes a feed network 330. The flap layer 310 includes a plurality of flaps 315. The unit cell 300 can be arranged on an antenna panel that is included in any one of the antennas 205*a*-205*n*.

The first layer including the patch 305 is the top layer of the unit cell 300. The patch 305 can be a quadrilateral shape and include slits 325 in each corner of the patch 305. For example, the patch 305 can be structured in the shape of a square or rectangle and include a slit 325 at each corner. In other embodiments, the patch 305 can be a circular shape and include four slits 325. For example, the four slits 325 can each be located ninety degrees apart. In some embodiments, the patch 305 can be a dielectric material in a layer of electromagnetic (EM) material such that EM radiation can pass through the dielectric material.

The first layer including the patch 305 can be arranged directly on top of the flap layer 310. The patch 305 is the main radiation element of the unit cell 300. The slits 325 can be used to widen the bandwidth of the unit cell 300.

The flap layer 310 is arranged under the patch 305. The flap layer 310 comprises a plurality of flaps 315 that form a cavity 350. In this embodiment, the flap layer 310 is a layer of EM material (e.g., a metal or other EM material) from which the plurality of flaps 315 is machined. For example, the plurality of flaps 315 of the flap layer 310 can be machined from (or otherwise formed in) a layer of any suitable EM material. In this example, the plurality of flaps 315 include four flaps that are positioned around the cavity 350.

The cavity 350 is created when the plurality of flaps 315 are machined from the flap layer 310. In some embodiments, the cavity 350 may be filled with a dielectric material, and thus may be considered to be a cavity of EM material in that no EM material is present in the cavity. In other embodiments, the cavity 350 can be filled with air and represent an absence of the EM material in the flap layer 310. Additionally, as illustrated in FIG. 3B, an air gap 370 is present between the layer including the patch 305 and the flap layer 310.

The feed network 330 includes a plurality of feed lines 335. Each of the plurality of feed lines 335 includes an excitation port 340 and a transmission line 345. The excitation port 340 receives power from a power source to power the unit cell 300. The transmission line 345 extends from the excitation port and has an end point below (when assembled) the cavity 350 created by the plurality of flaps 315.

In some embodiments, the plurality of feed lines 335 can be included in a common feed network that comprises the feed networks 330 of multiple unit cells 300. The feed network 330 can be implemented using any suitable techniques, such as a series feeding network, a corporate feeding network, a strip line feeding network, an asymmetric strip line, or an uneven strip line feeding network. The plurality of feed lines 335 can comprise one or more EM materials. For example, the plurality of feed lines 335 can be machined from any suitable EM material. Each of the plurality of feed lines 335 can be deposited onto the substrate layer 320.

For example, the excitation of a unit cell 300 can be realized by using an asymmetric strip line. A strip line can be formed by sandwiching metallic transmission lines between two grounded dielectric substrates, such as dielectric slabs, where the substrates are in touch with the transmission lines and the ground planes of the substrates are at the exterior. When one of the substrates is replaced with air, the strip line structure becomes asymmetric in comparison to the counterpart strip line. The structure of the asymmetric strip line can be adopted into the structure of the unit cell 300 to provide excitation and unidirection radiation by the plurality of slots 355.

The substrate layer 320 can be constructed of any suitable material for a massive MIMO antenna. For example, the substrate layer 320 can be constructed using FR4, a glass-reinforced epoxy laminate material. In some embodiments, the flap layer 310 can be deposited onto one side of the substrate layer 320 and the feed network 330 can be deposited onto the opposite side of the substrate layer 320.

The unit cell 300 also includes a plurality of slots 355. In these embodiments, the plurality of slots 355 are formed by the absence of EM material in a layer of EM material positioned between the substrate layer 320 and the flap layer 310. The plurality of slots 355 can be machined out of the layer of EM material that is on top of the substrate layer 320. When assembled, each of the transmission lines 335 extend past one of the plurality of slots 355 and end between opposing ones of the plurality of slots 355. The layer of EM material for the slots 355 can be metal or any other material that is a suitable conductor. The plurality of slots 355 is structured to allow EM energy to pass through the EM layer of material toward the patch 305. In some embodiments, the plurality of slots 355 can be present on one side of the substrate layer 320 and the feed network 330 can be deposited onto the opposite side of the substrate layer 320.

In this illustrative example, the plurality of slots 355 can include four separate slots 355. The four slots 355 can include a first set including two slots 355 arranged substantially parallel to each other and a second set including two slots 355 arranged substantially parallel to each other and perpendicular to the first set of slots 355. Each transmission line 335 can be associated with a separate slot 355. Each transmission line 335 can extend past one of the plurality of slots 355 and have an end point between opposing ones of the plurality of slots 355.

In some embodiments, the unit cell 300 can include a plurality of pins 360, each of which is connected to the bottom of the excitation port of one of the plurality of feed lines 335 and connected to the feed network 330. Each of the plurality of pins 360 may a coaxial cable and supply EM energy in the form of a modulated electrical current to the unit cell 300. The plurality of pins 360 is the point of excitation of the unit cell 300.

The structure of the unit cell 300 has a variety of advantages. In some embodiments, the unit cell 300 can be assembled without soldering, resulting in a cost-effective and less time consuming assembly. In some embodiments, the unit cell 300 can achieve a bandwidth of approximately 700 MHz (0.7 GHz) without sacrificing gain as a result of coupling the slits 325 with the spaces between the edge pieces of the flap layer 310. In some embodiments, the unit cell 300 utilizes strip-line feeding or asymmetric strip line feeding resulting in low mutual coupling. In some embodiments, the strip line feeding or asymmetric strip line feeding structure can include a filter.

Although described herein as a single unit comprising a variety of layers, this description is for illustration only. In some embodiments, each of the layers described herein can include a plurality of components for multiple unit cells 300. For example, the layer including the patch 305 can include a layer including a plurality of patches 305. The flap layer 310 including a plurality of flaps 315 can include more than one plurality of flaps 315. The substrate layer 320 can include multiple feed networks 330. When each of the layers described are arranged in a specific arrangement, for example in the arrangement described in FIGS. 4A-4C, an antenna panel may be created that includes a plurality of unit cells 300.

Figure 4A:
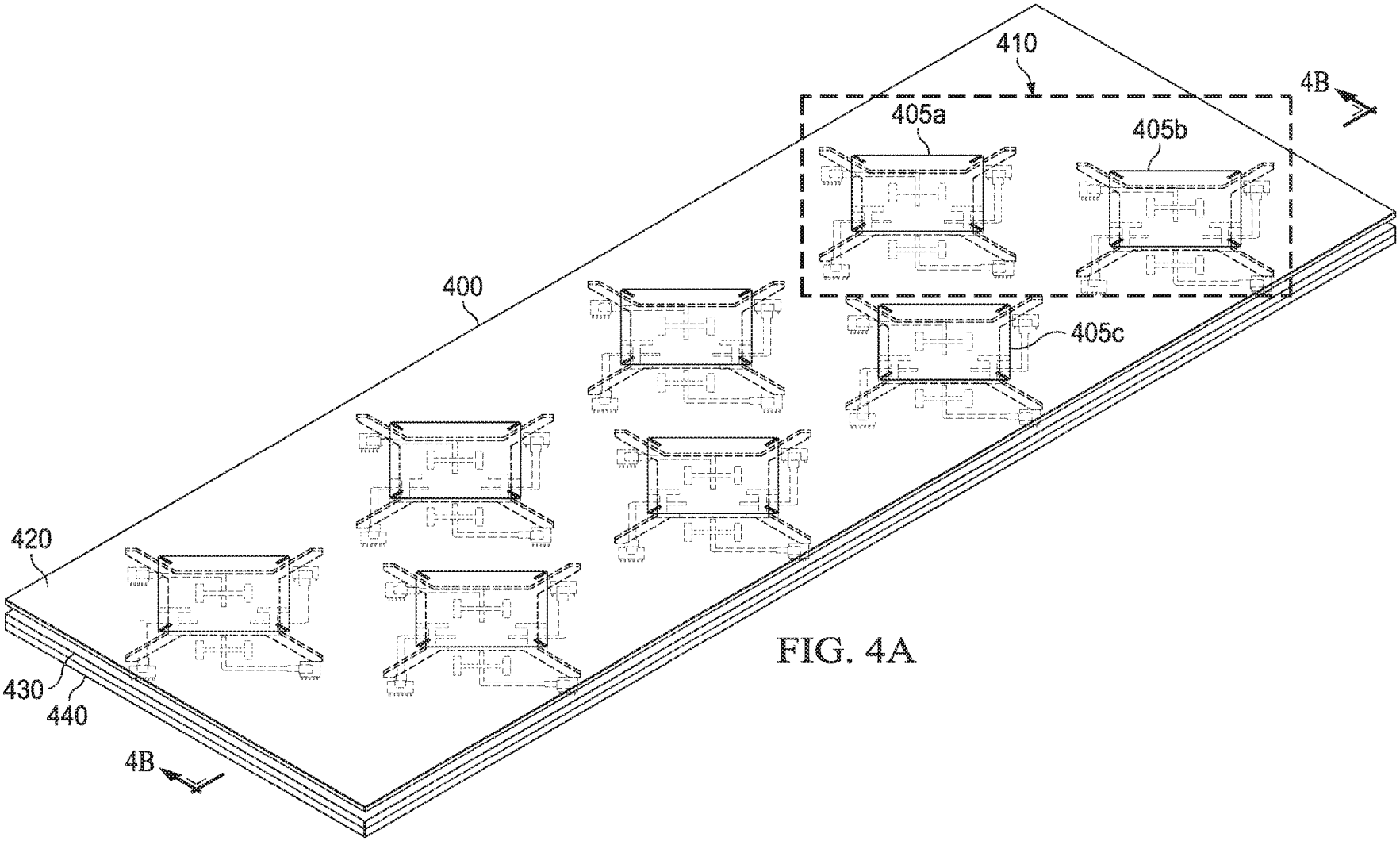
FIG. 4A illustrates a top perspective view of an antenna panel including unit cells in a staggered arrangement according to various embodiments of the present disclosure.
Figure 4B:
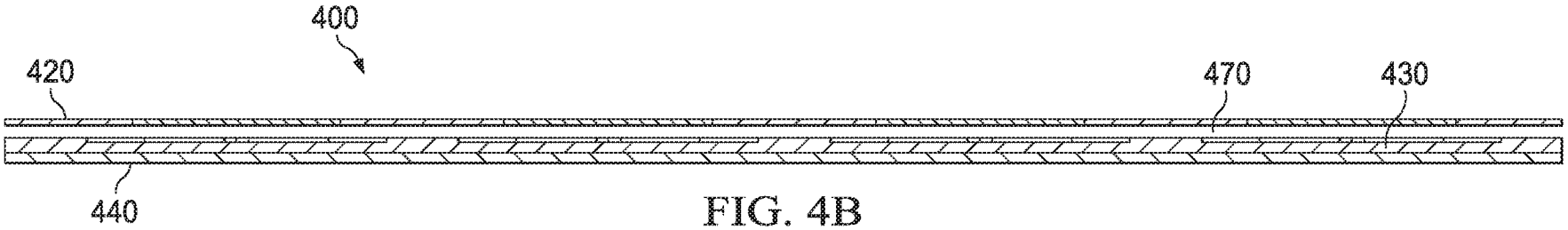
FIG. 4B illustrates a cut-through view of an antenna panel including unit cells in a staggered arrangement according to various embodiments of the present disclosure.
Figure 4C:
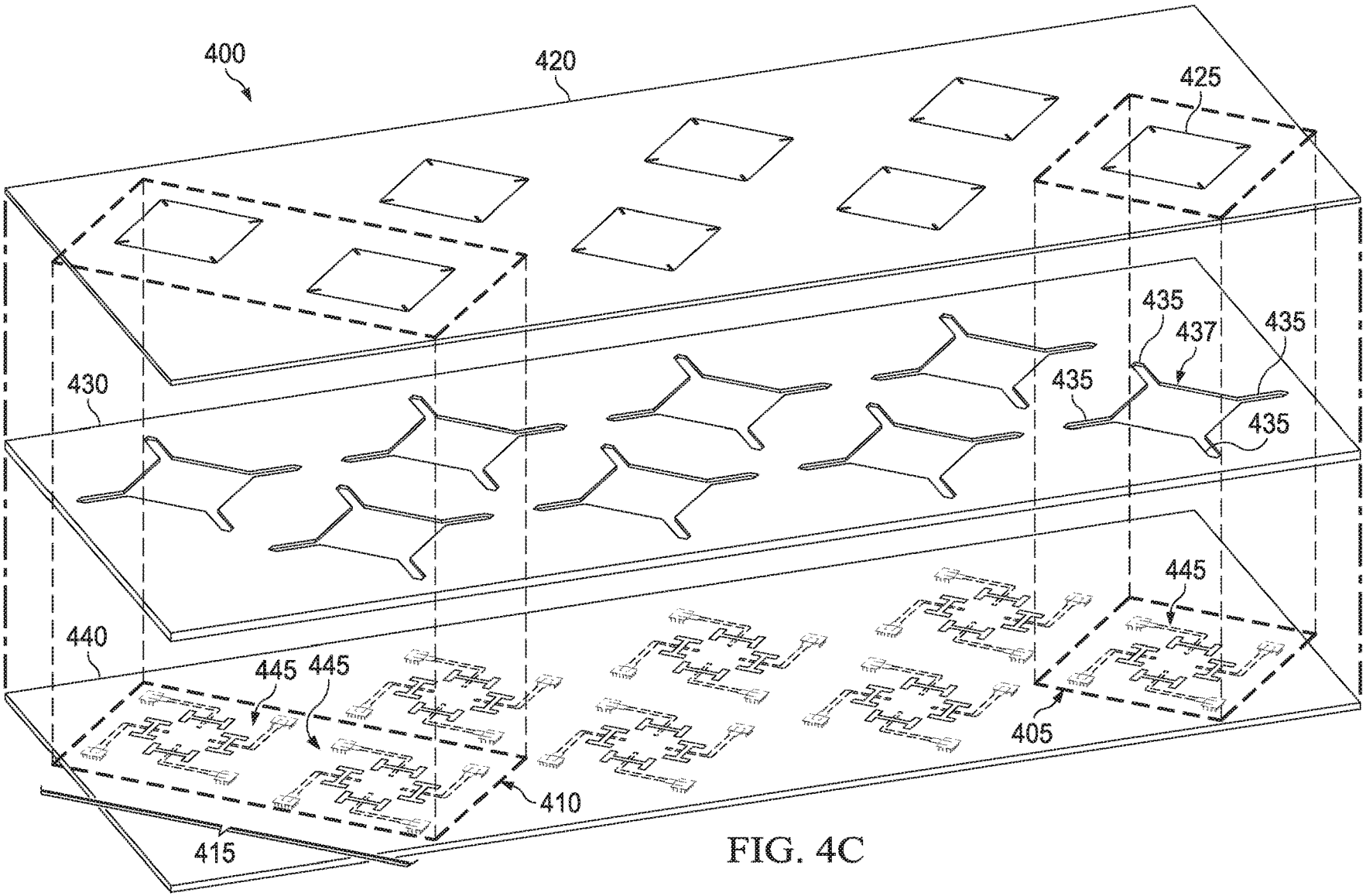
FIG. 4C illustrates an exploded view of an antenna panel including unit cells in a staggered arrangement according to various embodiments of the present disclosure.

FIGS. 4A-4C illustrate an antenna panel including a plurality of unit cells in a staggered arrangement according to various embodiments of the present disclosure. FIG. 4A illustrates a top perspective view of an antenna panel 400 including unit cells 405. FIG. 4B illustrates a cut through view of an antenna panel 400 including unit cells 405. FIG. 4C illustrates an exploded view of an antenna panel 400 including unit cells 405. In some embodiments, each of the unit cells 405 can be one of the unit cells 300.

The antenna panel 400 includes a plurality of unit cells 405. For example, as illustrated in FIG. 4A, the antenna panel 400 can include eight unit cells 405. In some embodiments, the antenna panel 400 can include more or less than eight unit cells 405. The antenna panel 400 can be included in an antenna, for example in any one of the antennas 205*a*-205*n*.

The antenna panel 400 can be comprised of multiple layers described in FIGS. 3A-3C. In particular, FIG. 4A illustrates the multiple layers with components of lower layers illustrated in dashed-lines for the ease of understanding of the structure of the antenna panel 400. For example, the antenna panel 400 can include a first layer 420 including a plurality of patches 425, a second layer 430 including multiple pluralities of flaps 435 and multiple cavities 437, and a third layer 440 including a plurality of feed networks 445. The antenna panel can include an air gap 470 between the second layer 430 and the third layer 440. Each unit cell 405 in the antenna panel 400 can include a patch 425, plurality of flaps 435, and a feed network 445. The patch 425 can be the patch 305. The plurality of flaps 435 can be the plurality of flaps 315. The feed network 445 can be the feed network 330.

The unit cells 405 can be positioned adjacent to each other in the antenna panel 400. In some embodiments, the unit cells 405 can be arranged into four sub-arrays 410. Each sub-array 410 can includes two unit cells 405. The two unit cells 405 included in the sub-array 410 can be arranged in a 1×2 arrangement at an approximately forty-five degree angle relative to one another. As discussed in greater detail below, in some embodiments, the two unit cells 405 in the sub-array 410 can include a common feed network 415. The common feed network 415 can include the feed networks 445 of each of the unit cells 405.

The structure of a plurality of unit cells 405 arranged in sub-arrays 410 can increase performance of the antenna panel 400. Arranging the unit cells 405 with sub-arrays 410 in a staggered arrangement can result in a more efficient common feed network 415 that allows the antenna panel 400 to achieve an overall improved radiation performance over a desired frequency band and moderate gain characteristics. The arrangement of the antenna panel 400 utilizing plurality of unit cells 405 can result in a gain of approximately 6 dB. The arrangement of the sub-arrays 410 on the antenna panel 400 can result in a gain of approximately 9 dB and provide wideband radiation over a range of 3.2-3.9 GHz.

The common feed network 415 can include an excitation port and a transmission line that feeds both unit cells 405 in the sub-array 410. The common feed network 415 is described in greater detail in the description of FIGS. 6 and 7 below.

As illustrated in FIGS. 4A-4C, the antenna panel 400 includes eight unit cells 405 arranged in a staggered configuration. For example, the unit cells 405 are positioned in the antenna panel 400 in a 2×4 arrangement with a 45 degree offset relative to each other. Although the unit cells 405 are shown in a 2×4 arrangement with a 45 degree offset relative to each other, this arrangement is for illustration only. Other embodiments are possible. For example, the antenna panel 400 can include sixteen unit cells 405 arranged in a 4×4 arrangement with a 45 degree offset relative to each other. In other embodiments, any number of unit cells 405 in any arrangement may be suitably used.

In some embodiments, although the feed networks 445 are incorporated into the common feed network 415 that feeds both unit cells 405 of the sub-array 410, the unit cells 405 can retain isolated polarizations. For example, the common feed network 415 can support a staggered arrangement of the unit cells 405, resulting in a polarization difference between the two unit cells 405. The polarization difference is introduced to each of the unit cells 405 by the common feed network 415. By feeding each of the feed networks 445 of both unit cells 405 of the sub-array 410 and retaining isolated polarizations, an associated RF circuit can provide a single differential feed for a subjective polarization by the common feed network 415. In various embodiments, each of the sub-arrays 410 can incorporate any suitable arrangement of feed networks, such as a series feeding network, a corporate feeding network, or a strip line feeding network. The common feed network 415 is used to optimize the beam-steering capability of the beams produced by the antenna panel 400.

The staggered configuration of the unit cells 405 in the sub-arrays 410 has several advantages. For example, in some embodiments, the staggered configuration may improve the side lobe level and beam steering performance of the beams transmitted from the antenna 400. In some embodiments, the staggered configuration may reduce cross-polarization radiation, improving the efficiency of the beams transmitted from the antenna 400. For example, the sub-arrays 410 can include a cross-polarization rejection ratio of 21 dB. The staggered configuration may further results in low-scan loss.

In some embodiments, the staggered configuration of the unit cells 405 provides an opportunity for the unit cells 405 of the sub-arrays 410 to also be coupled with unit cells 405 of different sub-arrays 410. For example, a sub-array 410 can include two unit cells 405*a* and 405*b*. The single unit cell 405*a* in the staggered configuration can be coupled with an adjacent unit cell 405*c* that is not included in the same sub-array 410 as the unit cell 405*a*. The single unit cell 405*a* can be observed to have a coupling of, for example, approximately −25 dB with the unit cell 405*c* at a frequency of 3.6 GHz. In addition, the unit cell 405*a* can be observed to have a coupling of, for example, approximately −30 dB with another unit cell 405 adjacent to the unit cell 405*a* at a frequency of 3.6 GHz.

In some embodiments, the unit cells 405 are not arranged into sub-arrays 410. Arranging the unit cells 405 in a staggered arrangement but without arranging the unit cells 405 into sub-arrays can result in various advantages. For example, the bandwidth of the antenna panel 400 can be improved and measured up to and including 600 MHz. The efficiency of the controlled-beam may be enhanced while reducing the complexity of the overall antenna system.

Figure 5A:
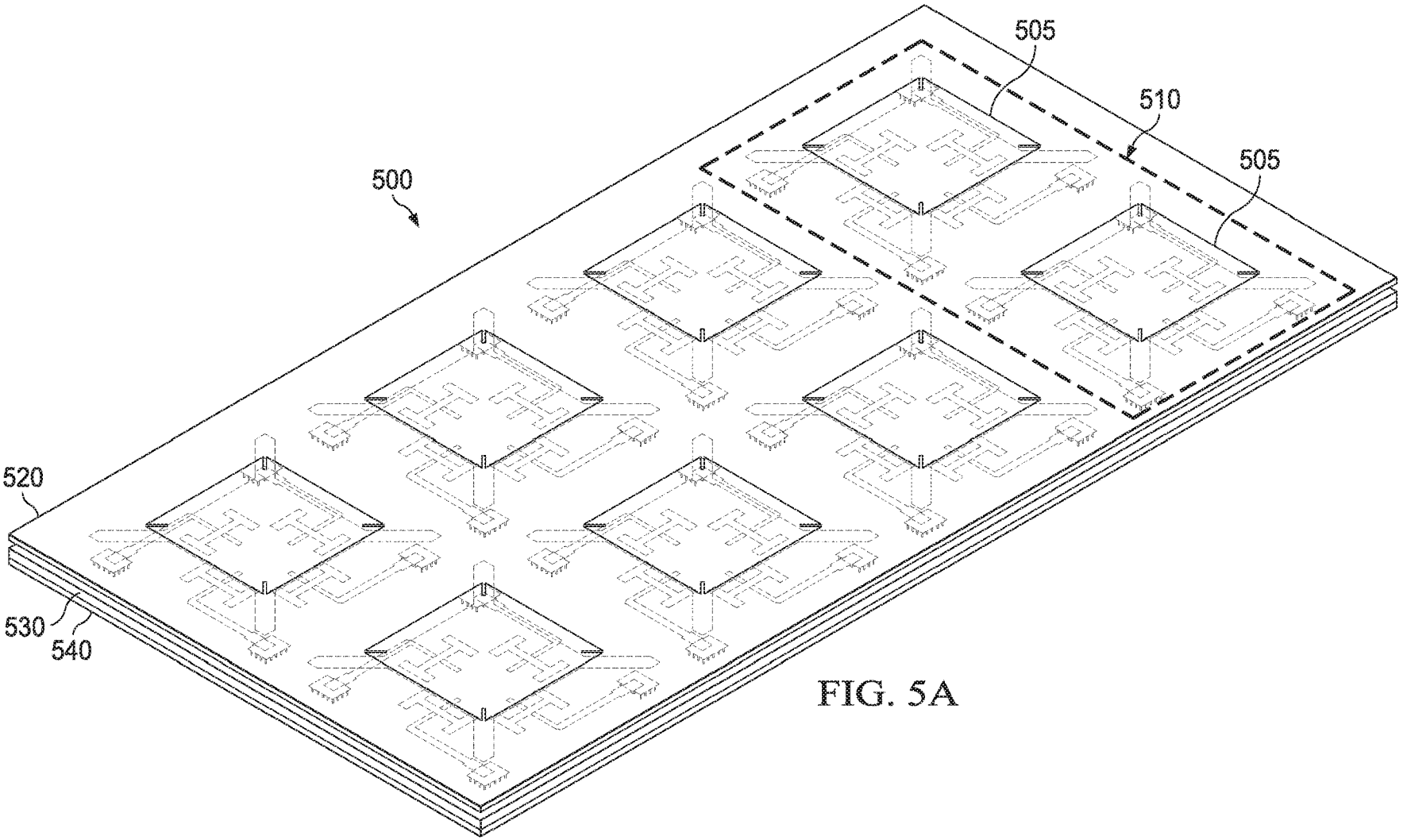
FIG. 5A illustrates a top perspective view of an antenna panel including unit cells according to various embodiments of the present disclosure.
Figure 5B:
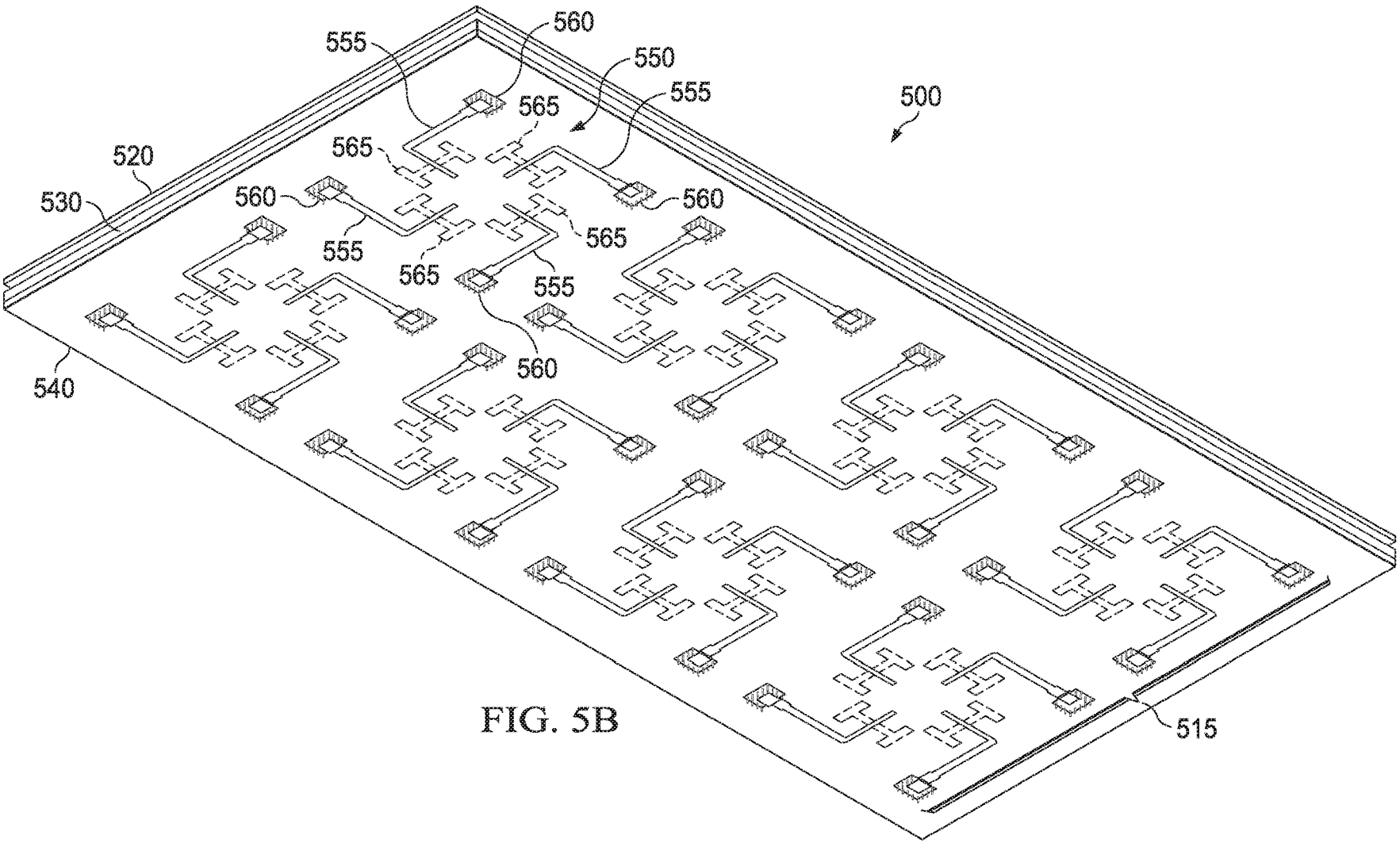
FIG. 5B illustrates a bottom perspective view of an antenna panel including unit cells according to various embodiments of the present disclosure.

FIGS. 5A-5B illustrate an antenna panel 500 including unit cells 505 according to various embodiments of the present disclosure. FIG. 5A illustrates a top perspective view of an antenna panel 500 including unit cells 505. FIG. 5B illustrates a bottom perspective view of an antenna panel 500 including unit cells 505. In some embodiments, each of the unit cells 505 can be one of the unit cells 300 or unit cells 405.

The antenna panel 500 includes a plurality of unit cells 505. For example, as illustrated in FIG. 5A, the antenna panel 500 can include eight unit cells 505. In some embodiments, the antenna panel 500 can include more or less than eight unit cells 505. The antenna panel 500 can be included in an antenna, for example in any one of the antennas 205*a*-205*n*. The antenna panel 500 can include the multiple layers described in FIGS. 3A-3C. In particular, similarly to FIG. 4A, FIG. 5A illustrates the multiple layers with components of lower layers illustrated in dashed-lines for the ease of understanding of the overall structure of the antenna panel 500. For example, the antenna panel 500 can include a first layer 520, a second layer 530, and a third layer 540. The first layer 520 can have the same structure as the first layer 420, the second layer 530 can have the same structure as the second layer 430, and the third layer 540 can have the same structure as the third layer 440.

The unit cells 505 can be positioned adjacent to each other in the antenna panel 500. In some embodiments, the unit cells 505 can be arranged into four sub-arrays 510. Each sub-array 510 includes two unit cells 505. The two unit cells 505 included in the sub-array 510 can be arranged in a 1×2 arrangement side by side one another. The two unit cells 505 in the sub-array 510 can include a common feed network 515. The common feed network 515 can include the feed networks 550 of each of the unit cells 505.

Each of the feed networks 550 can include the same structure as the feed network 330. For example, each of the feed networks 550 includes transmission lines 555 and an excitation port 560.

The common feed network 515 includes an excitation port and a transmission line that feeds both unit cells 505 in the sub-array 510. The common feed network 515 is described in greater detail in the description of FIGS. 6 and 7 below.

The antenna panel 500 can include eight unit cells 505 arranged in a side by side configuration. For example, the unit cells 505 are positioned in the antenna panel 500 in a 2×4 arrangement side by side with each other. Although the unit cells 505 are shown in a 2×4 arrangement, this arrangement is for illustration only. Other embodiments are possible. For example, the antenna panel 500 can include sixteen unit cells 505 arranged in a 4×4 arrangement. In other embodiments, any number of unit cells 405 in any arrangement may be suitably used.

In some embodiments, the structure of a plurality of unit cells 505 arranged in sub-arrays 510 can increase performance of the antenna panel 500. Arranging the unit cells 505 with sub-arrays 510 in this arrangement results in a more efficient common feed network 515 that allows the antenna panel 500 to achieve an overall improved radiation performance over a desired frequency band and moderate gain characteristics. In some embodiments, the arrangement of the sub-arrays 510 in the antenna panel 500 can result in a gain of equal to or greater than 6 dB and provide wideband radiation over a range of 3.2-3.9 GHz.

In some embodiments, although the feed networks are incorporated into the common feed network 515 that feeds both unit cells 505 of the sub-array 510, the unit cells 505 can retain isolated polarizations. For example, the common feed network 515 can support a staggered arrangement of the unit cells 505, resulting in a polarization difference between the two unit cells 505. In some embodiments, the sub-array includes a polarization difference of +45 and −45 degrees. The polarization difference is introduced to each of the unit cells 505 by the common feed network 515. By feeding each of the feed networks 550 of both unit cells 505 of the sub-array 510 and retaining isolated polarizations, the associated RF circuit can provide a single differential feed for a subjective polarization by the common feed network 515. In various embodiments, each of the sub-arrays 510 can incorporate any suitable feed network, such as a series feeding network, a corporate feeding network, or a strip line feeding network. The common feed network 515 is used to optimize the beam-steering capability of the beams produced by the antenna panel 500. For example, in some embodiments, the antenna panel 500 can achieve close to 700 MHz measured input impedance bandwidth using the sub-array 510.

As illustrated in FIG. 5B, in some embodiments, the feed network 550 can be deposited onto one side of the third layer 540 and the slots 565 can be present on the opposite side of the third layer 540.

Figure 6:
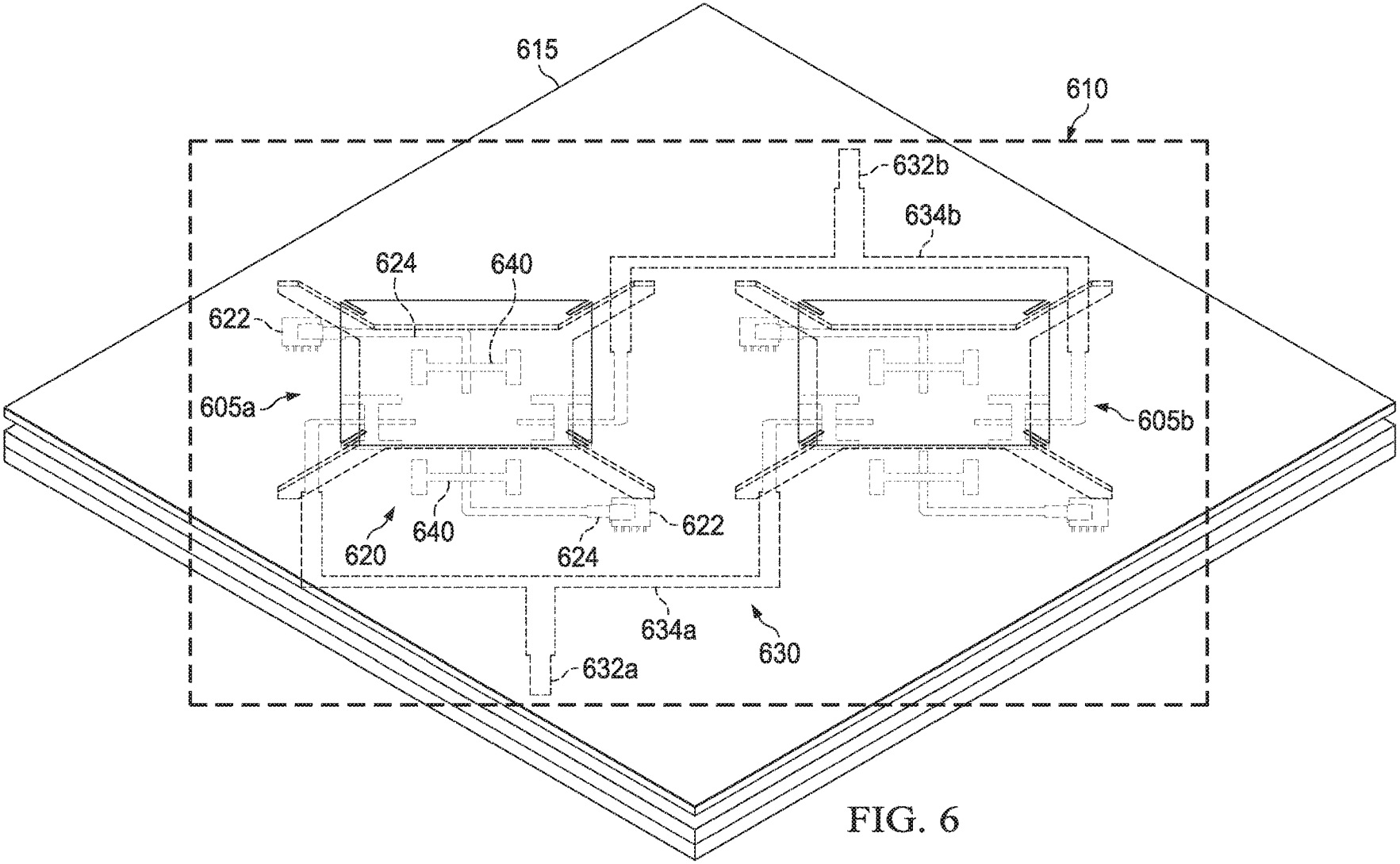
FIG. 6 illustrates a sub-array of unit cells according to various embodiments of the present disclosure.

FIG. 6 illustrates a sub-array 610 according to various embodiments of the present disclosure. The sub-array 610 includes two unit cells 605 included in an antenna panel 615. In various embodiments, the unit cells 605 can be any one of the unit cell 300, the unit cell 405, or the unit cell 505. In various embodiments, the sub-array 610 can be the sub-array 410 or the sub-array 510. In various embodiments, the antenna panel 615 can be the antenna panel 400 or the antenna panel 500.

The sub-array 610 includes two unit cells 605 arranged in the antenna panel 615. Each of the two unit cells 605 include an individual feed network 620 and share a common feed network 630. Each of the individual feed networks 620 include two excitation ports 622. Each of the two excitation ports 622 are connected to a transmission line 624.

The common feed network 630 is a feed network that feeds each of the unit cells 605 in the sub-array 610. The common feed network 630 includes two excitation ports 632. Each of the two excitation ports 632 are connected to a transmission line 634 that connects to each of the unit cells 605. For example, the excitation port 632*a* includes a transmission line 634*a* that connects to both the unit cell 605*a* and the unit cell 605*b*. The excitation port 632*b* includes a transmission line 634*b* that connects to both the unit cell 605*a* and the unit cell 605*b*.

The transmission lines 634 connect to each of the unit cells 605 in the same configuration. For example, as illustrated in FIG. 6, the transmission line 634*a* connects to each of the unit cells 605*a* and 605*b* on the west portion of the unit cells 605. As illustrated in FIG. 6, the transmission line 634*b* connects to the each of the unit cells 605*a* and 605*b* on the east portion of the unit cells 605. The terms "west" and "east" are for illustration only. Although illustrated in FIG. 6 as connecting to the west and east portions of the unit cells 605, the transmission lines 634 can connect to the unit cells 605 in any configuration that includes the transmission line

634*a* connected to the analogous location of each of the unit cells 605 and the transmission line 634*b* connected to the analogous location of each of the unit cells 605 that is different from the connection point of the transmission line 634*a*.

Each unit cell 605 includes a plurality of slots 640. The plurality of slots 640 can be the plurality of slots 355. Each of the transmission lines 624 and 634 can extend past one of the plurality of slots 640 and have an end point between opposing ones of the plurality of slots 640.

In various embodiments, the sub-array 610 arrangement can be utilized in the antenna panel 400 or the antenna panel 500. The sub-array 610 arrangement can be utilized to improve the gain of the antenna panel 400, 500. For example, in some embodiments, the utilization of the sub-array 610 arrangement can result in a realized gain of approximately 9 dB.

Figure 7:
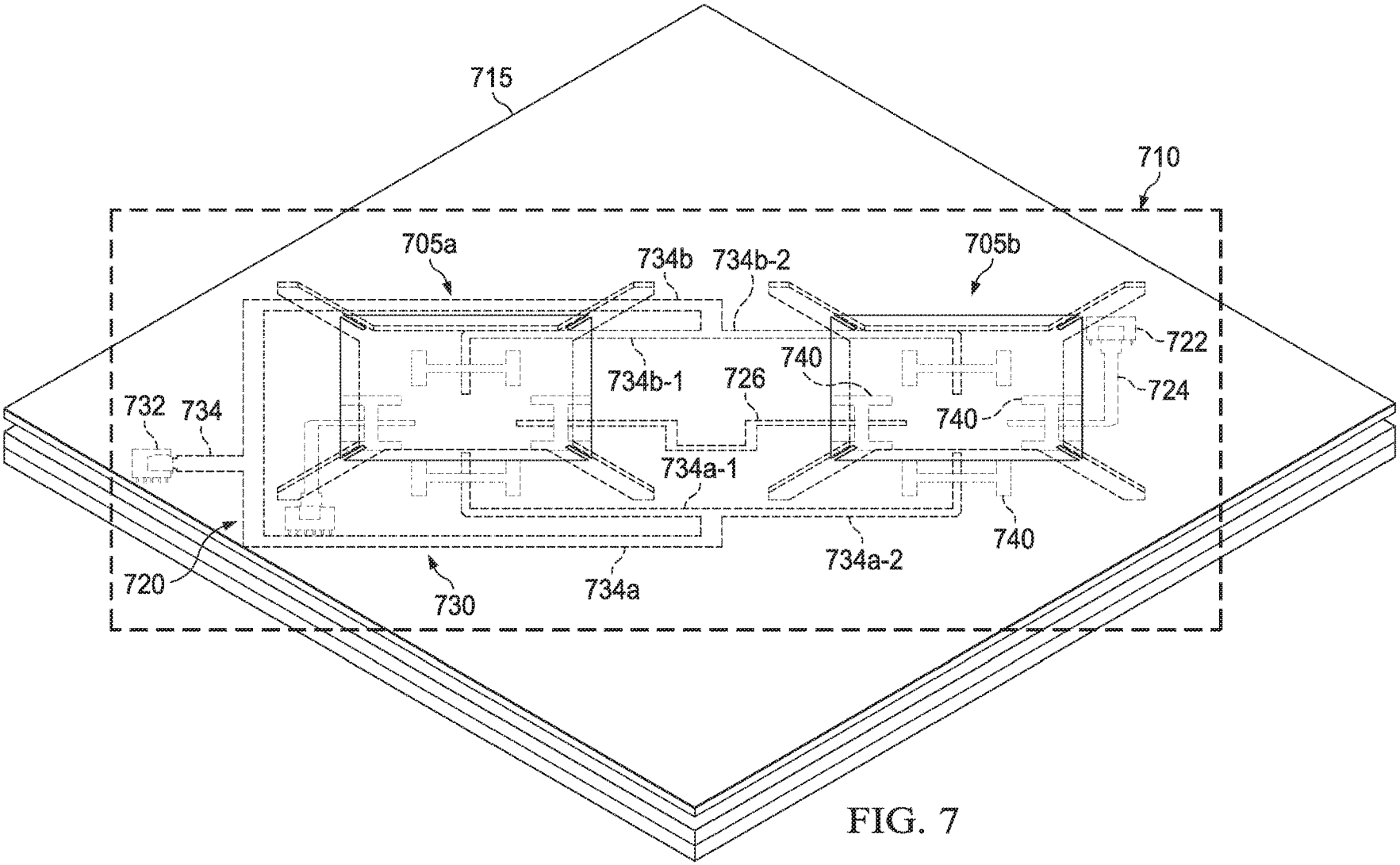
FIG. 7 illustrates a sub-array of unit cells according to various embodiments of the present disclosure.

FIG. 7 illustrates a sub-array 710 according to various embodiments of the present disclosure. The sub-array 710 includes two unit cells 705 arranged in an antenna panel 715. In various embodiments, the unit cells 705 can be any one of the unit cell 300, the unit cell 405, or the unit cell 505. In various embodiments, the sub-array 710 can be the sub-array 410 or the sub-array 510. In various embodiments, the antenna panel 715 can be the antenna panel 400 or the antenna panel 500.

The sub-array 710 includes two unit cells 705 arranged in the antenna panel 715. Each of the two unit cells 705 include an individual feed network 720 and share a common feed network 730. Each of the individual feed networks 720 include an excitation port 722. Each of the excitation ports 722 are connected to a transmission line 724. The two unit cells 705 also include a shared transmission line 726. One end of the shared transmission line 726 ends at the unit cell 705*a* and the other end of the shared transmission line 726 ends at the unit cell 705*b*.

In these embodiments, the shared transmission line 726 introduces, within the sub-array 710, a polarization difference of +45 and −45 degrees for the sub-array 710, or a 90 degree polarization difference between the unit cells 705*a* and 705*b*. As illustrated in FIG. 7, the shared transmission line 726 does not include an excitation port. However, other embodiments are possible. For example, the shared transmission line 726 can include a separate excitation port.

The common feed network 730 is a feed network that feeds each of the unit cells 705 in the sub-array 710. The common feed network 730 includes an excitation port 732. The excitation port 732 is connected to a transmission line 734 that connects to multiple locations of each unit cell 705. For example, the transmission line 734 includes a first portion 734*a* that splits into two branches 734*a*-1 and 734*a*-2 and a second portion 734*b* that splits into two branches 734*b*-1 and 734*b*-2. Branch 734*a*-1 connects to the south portion of unit cell 705*a* and branch 734*a*-2 connects to the south portion of unit cell 705*b*. Branch 734*b*-1 connects to the north portion of unit cell 705*a* and branch 734*b*-2 connects to the north portion of unit cell 705*b*. Although illustrated as connecting to the "south" and "north" portions of the unit cells 705, the transmission line 734 can connect to the unit cells 705 in any configuration that includes the first portion 734*a* connecting to the analogous location of the each of the unit cells 705 and the second portion 734*b* connecting to the analogous location of each of the unit cells 705 that is different from the connection point of the first portion 734*a*.

The common feed network 730 allows each of the unit cells 705 to provide at least one of vertical, horizontal, or orthogonal polarizations through a proper excitation setting. The individual feed networks 720 can be associated with orthogonal polarizations. The orthogonal polarizations are highly isolated resulting in a desired cross polarization rejection ratio. In a sub-array 710 including two or more unit cells 705, the individual feed networks 720 of each of the unit cells 705 can be linked together to form the common feed network 730 for a particular polarization orientation. For example, the individual feed networks 720 of each of the unit cells 705 can be linked together to form the common feed network 730 for an orthogonal polarization.

Each unit cell 705 includes a plurality of slots 740. The plurality of slots 740 can be the plurality of slots 355. Each of the transmission lines 724, 726, and 734 can extend past one of the plurality of slots 740 and have an end point between opposing ones of the plurality of slots 40.

In various embodiments, the sub-array 710 arrangement can be utilized in the antenna panel 400 or the antenna panel 500. The sub-array 710 arrangement can be utilized to improve the gain of the antenna panel 400, 500. For example, in some embodiments, the utilization of the sub-array 710 arrangement can result in a cross-polarization rejection ratio of 21 dB.

Figure 8A:
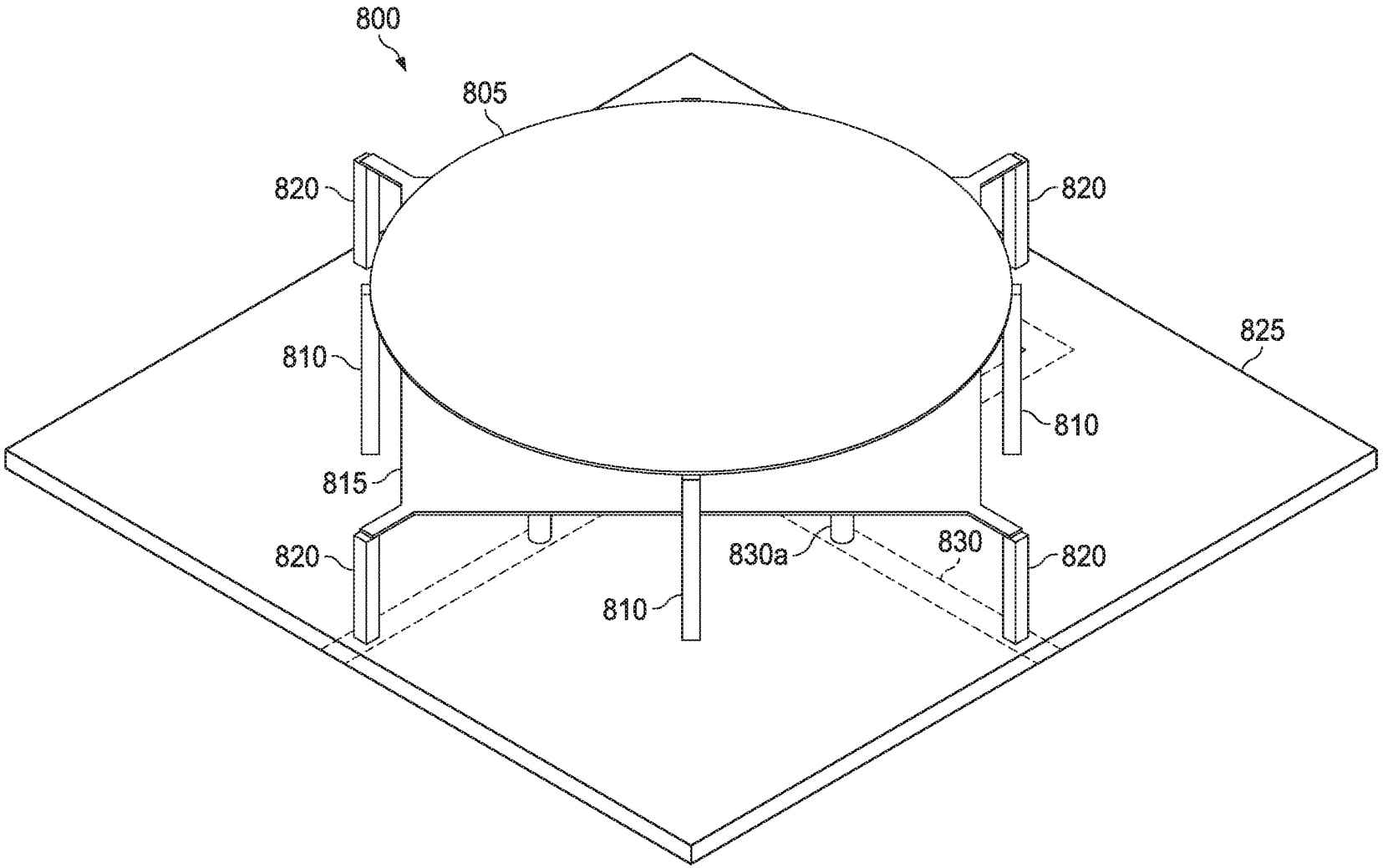
FIG. 8A illustrates a top perspective view of a unit cell according to various embodiments of the present disclosure.
Figure 8B:
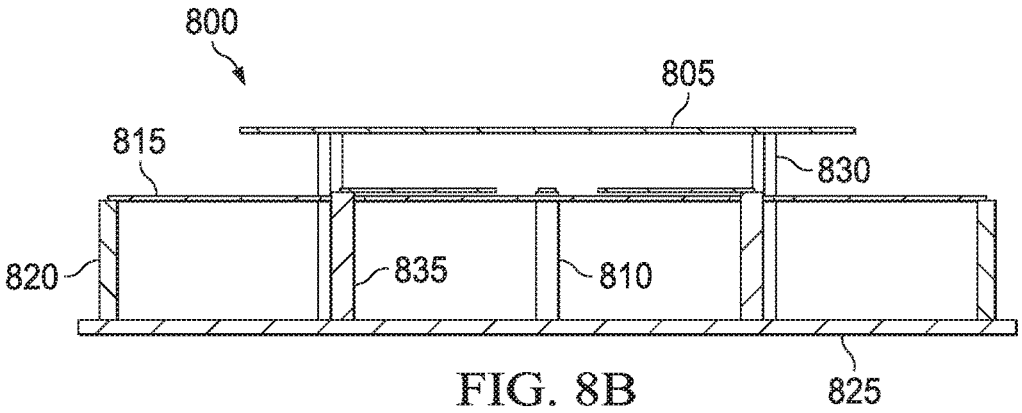
FIG. 8B illustrates a cut-through view of a unit cell according to various embodiments of the present disclosure.
Figure 8C:
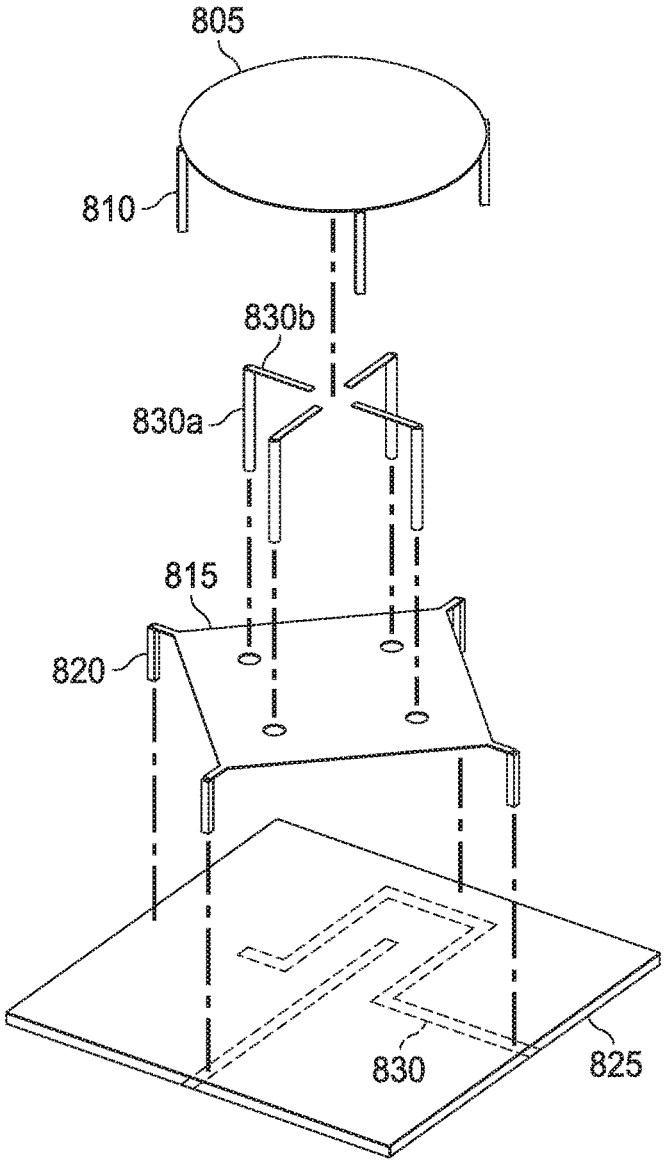
FIG. 8C illustrates an exploded view of a unit cell according to various embodiments of the present disclosure.

FIGS. 8A-8C illustrate a unit cell 800 according to various embodiments of the present disclosure. FIG. 8A illustrates a top perspective view of a unit cell 800. FIG. 8B illustrates a cut through view of a unit cell 800. FIG. 8C illustrates an exploded view of a unit cell 800. Although FIGS. 8A-8C illustrate one example of a unit cell 800, various changes may be made to FIGS. 8A-8C. Various components in FIGS. 8A-8C could be combined, further subdivided, or omitted and additional components could be added according to particular needs.

The unit cell 800 can include three layers. The unit cell 800 includes a first layer including a top circular patch 805, a second layer including a bottom square patch 815, and third layer 825 that includes a feed network 830.

The unit cell 800 can be arranged in an antenna panel that is included in any one of the antennas 205*a*-205*n*. The bottom square patch 815 includes supports 820 to maintain the second layer including the bottom square patch 815 a distance above the third layer 825. The top circular patch 805 includes legs 810 to maintain the first layer including the top circular patch 805 in a position above the second layer including the bottom square patch 815 in relation to the third layer 825.

The top circular patch 805 can be placed on the bottom side of a first dielectric sheet or replace a portion of the first dielectric sheet that has been removed. The bottom square patch 815 can be placed on the bottom side of a second dielectric sheet or replace a portion of the second dielectric sheet that has been removed. The first and second dielectric sheets can comprise the same material. For example, the first and second dielectric sheets can be 0.508 mm thick Rogers 4350 and include a permittivity of 3.66 and a loss-tangent of 0.004. The second layer including the bottom square patch 815 can be held a first distance above the third layer 825 by the supports 820. For example, the first distance can be 7 mm. The first layer including the top circular patch 805 can be held a second distance above the third layer 825 by the legs 810. For example, the second distance can be 11 mm. The feed network 830 can be located on the third layer 825. For example, the feed network 830 can be machined or deposited onto the third layer 825.

The feed network 830 includes vertical feeds 830*a* and horizontal feeds 830*b*. The vertical feeds 830*a* transfer a current that is received on the feed network 830 vertically through the unit cell 800. Each of the vertical feeds 830*a* is surrounded by a pin 835. The pins 835 stabilize the vertical feed 830*a* and are connected to the excitation port of the feed network 830. In some embodiments, the pins 835 can additionally maintain proper spacing between the layer including the bottom square patch 815 and the third layer 825. The horizontal feeds 830*b* transfer the current horizontally through the unit cell 800.

The feed network 830 can comprise a built-in 180° hybrid. The feed network 830 provides the differential excitation to the top circular patch 805 and the bottom square patch 815 as an approach to improve the cross-polarization rejection ratio. In some embodiments, the cross-polarization can be independent of the observation angle.

The unit cell 800 can be used in a characteristic mode based antenna design (CMA). In some embodiments, the unit cell 800 can be used in an antenna benefitting the concept of CMA that utilizes stacked or multiple antennas to improve the radiated gain of the antenna. For example, the antenna can be a Yagi-Uda antenna. The use of stacked or multiple antennas can increase the bandwidth of the antenna. Various embodiments of the present disclosure combine the use of CMAs and multiple resonator antennas to increase the bandwidth while achieving a high gain.

Figure 9A:
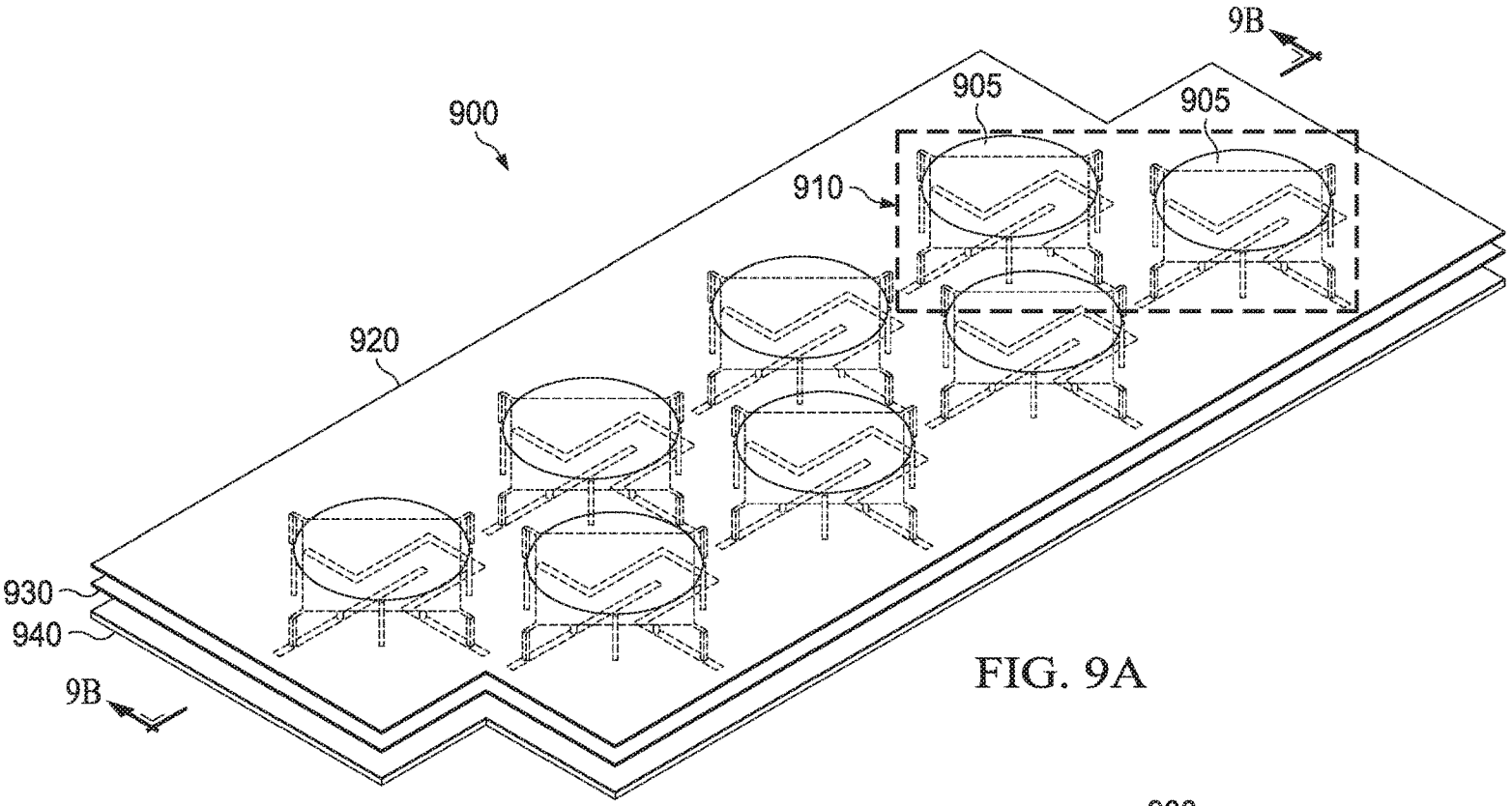
FIG. 9A illustrates a top perspective view of an antenna panel including unit cells according to various embodiments of the present disclosure.
Figure 9B:
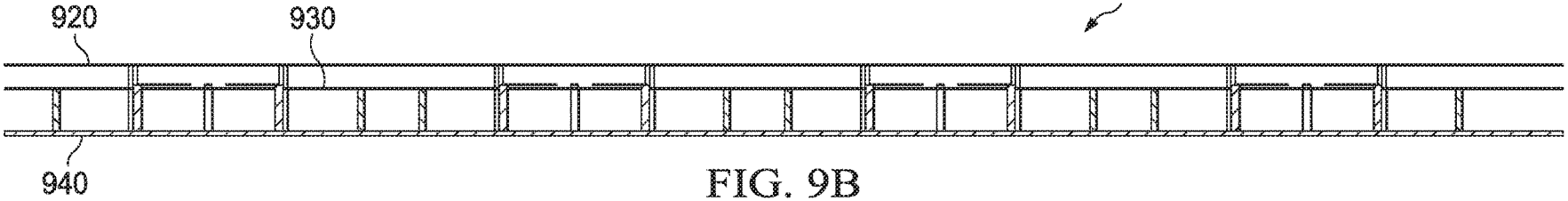
FIG. 9B illustrates a cut-through view of an antenna panel including unit cells according to various embodiments of the present disclosure.
Figure 9C:
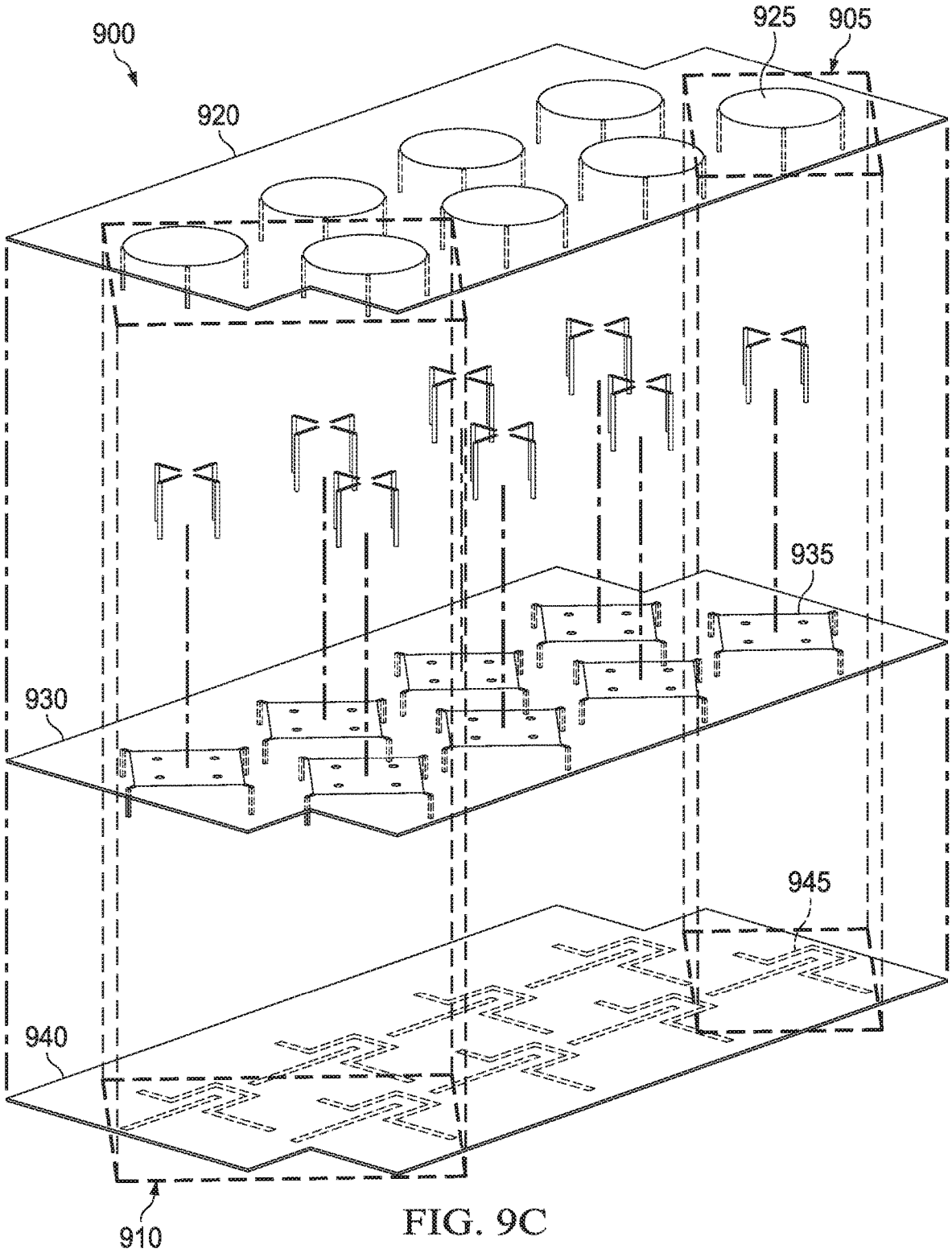
FIG. 9C illustrates an exploded view of an antenna panel including unit cells according to various embodiments of the present disclosure.

FIGS. 9A-9C illustrate an antenna panel 900 including unit cells according to various embodiments of the disclosure. FIG. 9A illustrates a top perspective view of an antenna panel 900 including unit cells 905 according to various embodiments of the present disclosure. FIG. 9B illustrates a cut-through view of an antenna panel 900 including unit cells 905 according to various embodiments of the present disclosure. FIG. 9C illustrates an exploded view of an antenna panel 900 including unit cells 905 according to various embodiments of the present disclosure. In some embodiments, each of the unit cells 905 can be one of the unit cells 800.

The antenna panel 900 includes a plurality of unit cells 905. For example, as illustrated in FIG. 9A, the antenna panel 900 can include eight unit cells 905. In some embodiments, the antenna panel 900 can include more or less than eight unit cells 905. The antenna panel 900 can be in an antenna, for example in any one of the antennas 205*a*-205*n*.

The antenna panel 900 can be comprised of multiple layers described in the description of the unit cell 800 in FIGS. 8A-8C. For example, the antenna panel 900 can include a first layer 920 including a plurality of top circular patches 925, a second layer 930 including multiple bottom square patches 935, and a third layer 940 including a plurality of feed networks 945. Each unit cell 905 in the antenna panel 900 can include a top circular patch 925, a bottom square patch 935, and a feed network 945.

The unit cells 905 can be positioned in the antenna panel 900 in any suitable arrangement. For example, as illustrated in FIGS. 9A-9C, the unit cells 905 can be positioned in a staggered arrangement in which the unit cells 905 are arranged in a 2×4 arrangement with a 45 degree offset relative to each other. In another embodiment, the unit cells 905 can be arranged in a 2×4 arrangement with no offset. Some embodiments of the antenna panel 900 can include more than eight unit cells 905. For example, if the antenna panel 900 includes sixteen unit cells 905 then the unit cells 905 can be arranged in 4×4 or 2×8 arrangements.

In some embodiments, the unit cells 905 can be arranged in a sub-array 910. The sub-array 910 can include two unit cells 905. In some embodiments, the sub-array 910 can include a common feed network 915 that that allows the antenna panel 900 to achieve an overall wideband radiation performance over a desired frequency band and moderate gain characteristics.

In some embodiments, the antenna panel 900 can achieve a measured, radiated gain of greater than 11.5 dB. In some embodiments, the antenna panel 900 can achieve a cross-polarization rejection ration (CPRR) of greater than 18 dB. In some embodiments, the antenna panel 900 can achieve a measured return loss (RL) of greater than 20 dB. In some embodiments, the sub-arrays 910 of the antenna panel 900 can achieve a measured, port-to-port isolation of greater than 20 dB. In some embodiments, the antenna panel 900 can achieve a measured in-plane of greater than 25 dB. In some embodiments, the antenna 900 can achieve a measured cross-coupling of greater than 30 dB. In some embodiments, the antenna panel 900 can achieve a measured bandwidth (BW) of 200 MHz.

In some embodiments, the antenna panel 900, as illustrated in FIGS. 9A-9C, results in various advantages when used, for example, in massive MIMO antenna arrays. The antenna panel 900 is a modular, cost-effective design that can be produced with relative ease. The antenna panel 900 includes a built-in differential feed network and backplane excitation, the structure of which results in an antenna panel 900 that can be integrated relatively easily. Structurally, the antenna 900 as illustrated in FIGS. 9A-9C is stable and durable, while maintaining a light weight for ease in integration into an antenna array.

In some embodiments, the gradual progression of the phase of the electromagnetic waves is the result of the progression of a phase shift in the feed networks of the antenna panel. For example, the beam can be steered by manipulating the cross-polarization of the feed networks by using the RF currents received through the excitation ports.

None of the description in this application should be read as implying that any particular element, step, or function is an essential element that must be included in the claim scope. Moreover, none of the claims is intended to invoke 35 U.S.C. § 112(f) unless the exact words "means for" are followed by a participle.

What is claimed is:

1. An antenna comprising:

at least one unit cell, the at least one unit cell comprising:

a flap layer including a plurality of flaps that are formed as enclosed within the flap layer and extend inward from respective corners of the flap layer, a feed network positioned below the flap layer, the feed network including a plurality of feed lines, each of the plurality of feed lines including an excitation port and a transmission line, and a patch having a quadrilateral shape, the patch positioned above flap layer such that an air gap is present between the patch and the flap layer.

2. The antenna of claim 1, further comprising:

a plurality of slots positioned between the flap layer and the feed network, wherein each of the transmission lines extends past one of the plurality of slots and has an end point between opposing ones of the plurality of slots.

3. The antenna of claim 2, wherein:

a cavity is formed by the plurality of flaps in the flap layer above a layer for the feed network;

the flap layer is a layer of electromagnetic material with the plurality of flaps machined therefrom; and the plurality of flaps include four flaps positioned around the cavity.

4. The antenna of claim 2, further comprising:

an antenna panel, wherein the at least one unit cell comprises a plurality of unit cells positioned adjacent to each other in the antenna panel at an approximately forty-five degree angle relative to a length of the antenna panel.

5. The antenna of claim 1, wherein:

the flap layer is formed on one side of a substrate and the feed network is formed on the other side of the substrate; and the plurality of flaps and the transmission lines are formed from one or more electromagnetic materials.

6. The antenna of claim 5, further comprising an antenna panel, wherein the at least one unit cell comprises a plurality of unit cells positioned adjacent to each other in the antenna panel.

7. The antenna of claim 1, wherein the patch includes a slit in each corner of the patch.

8. The antenna of claim 1, wherein the at least one unit cell comprises two unit cells forming a sub-array, the unit cells in the sub-array sharing a common feed network.

9. The antenna of claim 8, wherein:

the sub-array includes an orthogonal polarization with a difference of +90 and −90 degrees; and the difference is introduced via the common feed network.

10. The antenna of claim 1, further comprising an antenna panel including a plurality of sub-arrays, each of the sub-arrays including two unit cells sharing a common feed network.

11. The antenna of claim 1, wherein the feed network is an asymmetric stripline feed network.

12. The antenna of claim 11, further comprising a plurality of pins, each pin connected to the excitation port of one of the plurality of feed lines and connected to the asymmetric stripline feed network.

13. A base station comprising:

an antenna including at least one unit cell, the at least one unit cell comprising:

a flap layer including a plurality of flaps that are formed as enclosed within the flap layer and extend inward from respective corners of the flap layer, a substrate layer including a feed network positioned below the flap layer, the feed network including a plurality of feed lines, each of the plurality of feed lines including an excitation port and a transmission line, and a patch having a quadrilateral shape, the patch positioned above a void in the flap layer and separated from the flap layer such that an air gap is present between the patch and the flap layer, a transceiver configured to transmit and receive signals via the antenna; and a controller configured to control the transceiver to transmit and receive the signals.

14. The base station of claim 13, wherein the at least one unit cell further includes:

a plurality of slots in a plane, the plane including the slots positioned between the flap layer and the feed network in a first dimension, wherein each of the transmission lines extends from the excitation port past one of the plurality of slots in a second dimension and has an end point between opposing ones of the plurality of slots in the second dimension.

15. The base station of claim 14, wherein:

the flap layer is a layer of electromagnetic material with the plurality of flaps machined therefrom so as to form a cavity adjacent to and surrounded, in first and second dimensions, by the plurality of flaps, the cavity is between the patch and the feed network in a third dimension; and the plurality of flaps include four flaps positioned around the cavity in the first and second dimensions.

16. The base station of claim 13, wherein:

the flap layer is formed on one side of a substrate and the feed network is formed on the other side of the substrate; and the plurality of flaps and the transmission lines are formed from one or more electromagnetic materials.

17. The base station of claim 13, wherein the patch includes a slit in each corner of the patch.

18. The base station of claim 13, wherein the at least one unit cell comprises two unit cells forming a sub-array, the unit cells in the sub-array sharing a common feed network.

19. The base station of claim 18, wherein:

the sub-array includes an orthogonal polarization with a difference of +90 and −90 degrees; and the difference is introduced via the common feed network.

20. The base station of claim 13, wherein the antenna further comprises a plurality of pins, each pin connected to the excitation port of one of the plurality of feed lines and connected to the feed network.

* * * * *